US012135193B1

(12) United States Patent
Crye

(10) Patent No.: US 12,135,193 B1
(45) Date of Patent: Nov. 5, 2024

(54) MOBILE MUNITION ASSEMBLY AND APPARATUS, SYSTEMS, AND METHODS OF EXECUTING A MISSION FOR THE MOBILE MUNITION ASSEMBLY

(71) Applicant: Caleb Crye, Brooklyn, NY (US)

(72) Inventor: Caleb Crye, Brooklyn, NY (US)

( * ) Notice: Subject to any disclaimer, the term of this patent is extended or adjusted under 35 U.S.C. 154(b) by 0 days.

(21) Appl. No.: 18/527,892

(22) Filed: Dec. 4, 2023

Related U.S. Application Data

(63) Continuation-in-part of application No. 17/703,157, filed on Mar. 24, 2022.

(60) Provisional application No. 63/220,656, filed on Jul. 12, 2021.

(51) Int. Cl.
*F41G 7/34* (2006.01)
*F42B 15/01* (2006.01)

(52) U.S. Cl.
CPC ..... *F41G 7/343* (2013.01); *F41G 7/346* (2013.01); *F42B 15/01* (2013.01)

(58) Field of Classification Search
CPC .. F41F 3/04; F41G 7/343; F41G 7/346; F42B 15/01
See application file for complete search history.

(56) References Cited

U.S. PATENT DOCUMENTS 6,244,535 B1 6/2001 Felix
6,260,797 B1 * 7/2001 Palmer ..... B64D 37/04 102/501
6,321,737 B1 * 11/2001 Johnson ..... F41B 11/641 124/75
7,249,730 B1 * 7/2007 Flippen, Jr. ..... F41G 7/346 342/61
8,115,149 B1 * 2/2012 Manole ..... F42B 10/18 244/45 R (Continued)

FOREIGN PATENT DOCUMENTS

CN 109447398 A 3/2019
CN 112783195 A * 5/2021 ..... G05D 1/101

(Continued)

OTHER PUBLICATIONS

Machine Translation of CN112783195A.*

(Continued)

*Primary Examiner* — Sahar Motazedi
(74) *Attorney, Agent, or Firm* — Patterson Intellectual Property Law, PC

(57) ABSTRACT

A device may acquire an image of a target area located within the mission environment. A device may provide a first set of firing conditions to the munition, the first set of firing conditions corresponding at least to the target area. A device may provide authorization to the at least one mobile munition assembly for firing based at least on an airspace collision avoidance status dynamically determinable over a maximum future time of launch consideration (tmax). A device may be based on a provided authorization, firing the munition from the launcher according to the initial parameter set. A device may at the fired munition: measuring a second set of firing conditions, confirming an intended firing status of the munition by comparing the second set of firing conditions to the first set of firing conditions; and guiding the munition to the target area.

10 Claims, 18 Drawing Sheets

(56) References Cited

U.S. PATENT DOCUMENTS

| | | | | |
|---|---|---|---|---|
| 8,266,999 | B1 | 9/2012 | Sisemore et al. | |
| 8,397,613 | B2 | 3/2013 | Skurdal et al. | |
| 8,525,088 | B1 * | 9/2013 | Ell | F41G 7/2226 244/3.17 |
| 9,157,717 | B1 | 10/2015 | Carroll et al. | |
| 9,354,029 | B2 | 5/2016 | Mace et al. | |
| 9,772,155 | B2 | 9/2017 | Schechter | |
| 10,029,791 | B2 | 7/2018 | Roemerman et al. | |
| 10,648,781 | B1 * | 5/2020 | Behiel | F41A 33/00 |
| 10,757,000 | B2 | 8/2020 | Gelvin et al. | |
| 11,105,589 | B1 | 8/2021 | Bilbrey et al. | |
| 11,198,519 | B1 | 12/2021 | Seeley | |
| 2010/0000463 | A1 * | 1/2010 | Root, Jr. | B63B 22/18 114/316 |
| 2010/0320312 | A1 * | 12/2010 | Bril | F41G 7/2213 89/1.8 |
| 2011/0059421 | A1 | 3/2011 | Hickman | |
| 2016/0223278 | A1 * | 8/2016 | Schechter | F41A 17/063 |
| 2017/0286654 | A1 | 10/2017 | Nicoll | |
| 2019/0220039 | A1 * | 7/2019 | Wu | B64D 47/08 |
| 2020/0088887 | A1 * | 3/2020 | Garcia | G01S 5/06 |
| 2020/0101395 | A1 * | 4/2020 | Golliher | A63H 27/14 |
| 2020/0271420 | A1 * | 8/2020 | Peterson | F41G 3/04 |
| 2021/0070440 | A1 * | 3/2021 | Abeles | B64C 39/024 |
| 2021/0094703 | A1 * | 4/2021 | Catledge | B64G 1/242 |
| 2022/0177126 | A1 * | 6/2022 | Reddy | B64C 13/16 |

FOREIGN PATENT DOCUMENTS

| | | | | |
|---|---|---|---|---|
| EP | 3081892 | A1 * | 10/2016 | |
| EP | 4239277 | A1 * | 9/2023 | F41G 7/006 |
| KR | 20150104323 | A * | 9/2015 | |
| KR | 102021595 | B1 * | 9/2019 | |
| RU | 2213315 | C2 * | 9/2003 | |
| WO | 2016024921 | A1 | 2/2016 | |
| WO | 2021014101 | A1 | 1/2021 | |
| WO | 2021156634 | A1 | 8/2021 | |

OTHER PUBLICATIONS

Machine Translation of EP3081892A1.*
Machine Translation of EP4239277A1.*
Machine Translation of KR102021595B1.*
Machine Translation of KR20150104323A.*
Machine Translation of RU2213315C2.*

* cited by examiner

MOBILE MUNITION ASSEMBLY AND APPARATUS, SYSTEMS, AND METHODS OF EXECUTING A MISSION FOR THE MOBILE MUNITION ASSEMBLY

CROSS-REFERENCES TO RELATED APPLICATIONS

This application is a continuation-in-part of U.S. Non-provisional patent application Ser. No. 17/703,157, filed Mar. 24, 2022, which claims the benefit of U.S. Provisional Patent Application No. 63/220,656, filed Jul. 12, 2021, both of which are hereby incorporated by reference in their entirety.

A portion of the disclosure of this patent document contains material that is subject to copyright protection. The copyright owner has no objection to the reproduction of the patent document or the patent disclosure, as it appears in the U.S. Patent and Trademark Office (USPTO) patent file or records, but otherwise reserves all copyright rights whatsoever.

FIELD OF THE DISCLOSURE

The present disclosure relates to a mobile munition assembly, and more particularly to apparatus, systems, and methods of authorizing and executing a mission for the mobile munition assembly.

BACKGROUND

Various examples of systems and methods for launching and/or controlling a flight of a munition subsequent to launch, and executing a mission thereof, are conventionally known. Current mission execution systems for munition assemblies, the systems of which are configured to detect, identify, and/or target one or more targets in the mission environment, are limited by industry-standard specifications for mission safety, including (without limitation) the MIL-STD-882, DO-178, and other safety-critical standards. Due to these limitations, mission execution systems are generally not implemented on electronic devices made available to a layperson (i.e., a consumer), such as a smart cellular device employing an Apple- or Android-based operating system (OS). These safety-critical standards are generally not met with conventional versions of the aforementioned electronic devices or equivalents thereof because the software, or other executable algorithm, effectuating the process of executing the mission are not independent of hardware or software natively provided for in these electronic devices. Accordingly, because of the lack of independence of the hardware or software natively provided for in these electronic devices, users (or autonomous systems) must rely on costly electronic devices having specially configured hardware and software specifications that provide safety criticality and fail-safe execution, such as a lightweight handheld mortar ballistic computer (LHMBC).

In addition to the foregoing drawbacks, current mission execution systems, even on electronic devices having specially configured hardware and software (as described above), fail to provide real-time feedback of mission approval, whether caused by significant delays in a mission-rejection feedback loop, or through communication errors leading to a failure to reject (or accept) missions for the munition assembly. These failures limit the one or more devices to advising whether to accept or to reject the mission for the munition assembly, but do not, or cannot, authorize an acceptance or a rejection of the mission, such that the mission for the munition assembly may execute the mission in the mission environment.

Moreover, current munition execution systems necessitate or require user monitoring or intervention after a mission is approved, thereby preventing an autonomous execution of the mission. And, current mission execution systems generally necessitate or require a centralized authority or hierarchical system, whereby the centralized authority or the hierarchical system provide one or more users with information, data, and analytics on location, nature, or character of the one or more targets in the mission environment.

As a result, one or more munition assemblies may not be coordinated in an efficient manner because the one or more munition assemblies require the authorization of mission execution systems by the centralized authority or the hierarchical system, rather than by users operating within the mission environment in which the one or more munition assemblies are deployed. Users operating within the mission environment in which the one or more munition assemblies are deployed must further provide additional feedback or input to the mission execution systems after the mission is approved, including a designation of a target or a programming of a fuze within the warhead of the munition. Such additionally required actions by the user decrease the efficiency and effectiveness of coordinating and executing mission execution systems for munition assemblies in the mission environment.

Further, current methods of authorizing or executing the operation for the mobile munition assemblies require detailed airspace control measures in the form of procedural controls to limit and regulate the operation and flow of air traffic. These procedural controls require separating airspace horizontally, vertically, or both into various control zones and corridors such that authorized aircraft may pass only through designated zones. Another current method for dealing with such airspace restrictions includes disengaging all mobile munition assemblies within a mission environment to allow an aircraft to pass through and then re-engaging the mobile munition assemblies once the aircraft has passed through the airspace. These current methods fail to provide autonomous authorization for mission execution based on avoiding all potential collisions between munitions from such munition assemblies and aircraft occupying airspace over the mission environment. Accordingly, the mission authorization and execution are limited by the mere presence and possibility of aircraft in the airspace over the mission environment. Thus, there is a need to provide apparatuses, methods, or systems that overcome the foregoing limitations.

BRIEF SUMMARY

The present disclosure provides a novel mobile munition assembly. Specifically, the present disclosure provides a novel mobile munition assembly, as well as a method and a system for executing a mission for the mobile munition assembly.

Embodiments of apparatus, methods, and systems of the present disclosure provide a solution to the shortcomings above. In particular, this disclosure provides a mobile munition assembly for use in a mission environment. In some aspects, the techniques described herein relate to a method of executing a mission in a mission environment for at least one mobile munition assembly, each mobile munition assembly including a container and at least one launcher, each of the at least one launchers are configured to receive a munition, the method including: acquiring an image of a target area located within the mission environment; providing a first set of firing conditions to the munition, the first set of firing conditions corresponding at least to the target area; providing authorization to the at least one mobile munition assembly for firing based at least on a ground proximity status and an airspace collision avoidance status, both the ground proximity status and the airspace collision avoidance status dynamically determinable over a maximum future time of launch consideration ($t_{max}$); based on a provided authorization, firing the munition from the launcher according to the initial parameter set; and at the fired munition: measuring a second set of firing conditions; confirming an intended firing status of the munition by comparing the second set of firing conditions to the first set of firing conditions; and guiding the munition to the target area.

In some aspects, the techniques described herein relate to a method, wherein providing authorization to the at least one mobile munition assembly for firing further includes: receiving signals representative of at least one of a class of the munition or a class of an aircraft; receiving signals representative of situational awareness (SA) of the at least one of the mobile munitions assembly or the aircraft; determining future position areas of the at least one of the munition or the aircraft based at least on the signals representative of class of each of the at least one of the munition or the aircraft, and on the signals representative of the situational awareness (SA) of the at least one of the mobile munitions assembly or the aircraft.

In some aspects, the techniques described herein relate to a method, wherein: receiving class information of the munition further includes receiving a maximum $\Delta V$ and a maximum glide ratio of the munition; and determining the future position areas of the munition further includes: determining future position areas based on at least one potential malfunction status of the munition; determining future position areas based on a maximum flight path of the munition; and superimposing the future position areas based on the at least one potential malfunction status and the maximum flight path of the munition.

In some aspects, the techniques described herein relate to a method, wherein: receiving class information of at least one of the aircraft further includes receiving a maximum velocity of the aircraft; receiving signals representative of the situational awareness (SA) of at least one of the aircraft further includes: receiving signals representative of a time when the signals representative of the situational awareness (SA) of at least one of the aircraft was reported; and receiving signals representative of a last reported velocity ($V_{last}$) of at least one of the aircraft; and determining the future position area of at least one of the aircraft is based further on at least one of the signals representative of the maximum velocity of at least one of the aircraft, the signals representative of a time when the signals representative of the situational awareness (SA) of at least one of the aircraft was last reported, and the signals representative of the last reported velocity ($V_{last}$) of at least one of the aircraft.

In some aspects, the techniques described herein relate to a method, further including: receiving, at the at least one mobile munition assembly, a signal representative of a user command; and wherein providing authorization to the at least one mobile munition assembly for firing is based further on the signal representative of the user command.

In some aspects, the techniques described herein relate to a method, wherein: the signal representative of the user command includes signals representative of a class or of a situational awareness (SA) of at least one of the mobile munitions assembly or the aircraft.

In some aspects, the techniques described herein relate to a method, wherein confirming an intended firing status of the munition further includes: generating a processed signal based on at least the compared first and second sets of firing conditions; and disarming the munition in the absence of the processed signal.

In some aspects, the techniques described herein relate to a method, wherein: the second set of firing conditions includes at least one of heat, shock, light, static electricity, spin, acceleration, air pressure, or time elapsed since firing.

In some aspects, the techniques described herein relate to a method, further including: capturing, at the fired munition, at least one image of the target area; wherein providing the first set of firing conditions to the munition further includes providing the acquired image of the target area; and wherein guiding the munition to the target area further includes comparing the at least one captured image of the target area to the acquired image of the target area.

In some aspects, the techniques described herein relate to a method, further including: capturing, at the fired munition, two or more successive images of the target area; and wherein guiding the munition to the target area further includes comparing a later of the successive images to an earlier of the successive images.

In some aspects, the techniques described herein relate to a system for executing a mission in a mission environment, the system including: at least one mobile munition assembly including a container having a container frame, the container frame enclosing one or more launchers, each of the launchers being configured to receive a munition; one or more electronic devices, at least one of the one or more electronic devices further including: a communication unit, the communication unit is configured to communicatively couple each of the one or more electronic devices to one another such that each of the one or more electronic devices are in association with one another, and the communication unit configured to receive at least signals representative of a situational awareness (SA) corresponding to each of the one or more electronic devices; a safety module, the safety module is configured to evaluate and approve or reject the mission; and a airspace deconfliction (AD) module, the airspace deconfliction (AD) module is configured to: recognize a maximum future time of launch consideration ($t_{max}$); receive and process signals representative of a situational awareness (SA) corresponding to each of the one or more electronic devices to determine one or more mobile munition assemblies available for executing the mission based at least on the maximum future time of launch consideration ($t_{max}$); and provide available mobile munition assemblies to the safety module.

In some aspects, the techniques described herein relate to a system, wherein: the container includes a manpack, a vehicle module, or a stationary module; and the manpack includes a stabilizer associated with the manpack, the stabilizer including a plurality of legs movable between a stored position and a deployed position.

In some aspects, the techniques described herein relate to a system, wherein: the one or more electronic devices correspond to at least one of a mobile munition assembly or an aircraft.

In some aspects, the techniques described herein relate to a system, wherein: the signals representative of a situational awareness (SA) includes at least one of position location information (PLI) or position vector information (PVI).

In some aspects, the techniques described herein relate to a system, wherein: one of the electronic devices further includes an unmanned aerial vehicle (UAV), a designator, or an electronic communication device.

In some aspects, the techniques described herein relate to a system, wherein: the munition further includes: an initiator configured to sense firing information of the munition; and a controller operatively coupled to the initiator, the controller configured to: compare the firing information to at least one predetermined firing threshold; and generate a processed signal based at least on the comparison of the firing information to the predetermined firing threshold.

In some aspects, the techniques described herein relate to a system, wherein: the munition further includes: a munition frame, the munition frame further including: at least one of each of a deployable wing and fin for guiding the munition; and a controller operatively coupled to the deployable wing and fin for guiding the munition, the controller further configured to deploy the deployable wing and fin for guiding the munition based at least on the processed signal.

In some aspects, the techniques described herein relate to a system, further including: a launch frame, the launch frame further including: at least one deployable wing, one or more of the at least one of the deployable wing further including a camera; at least one deployable and movable fin; and a controller operatively coupled to wing, fin, and camera.

In some aspects, the techniques described herein relate to a system, wherein: the controller is configured to: recognize an acquired image of a target area, the target area located within the mission environment; cause the camera to capture an image of the target area; compare the captured image to the acquired image; establish a trajectory based at least on the compared images; and move the at least one fin based at least on the trajectory.

In some aspects, the techniques described herein relate to a system, wherein: the munition includes at least one of a global positioning system (GPS) or an inertial guidance system.

Unless otherwise defined, all technical and scientific terms used herein have the same meaning as commonly understood by one of ordinary skill in the art to which this invention belongs. The present invention may be embodied in other specific forms without departing from the spirit or essential attributes thereof, and it is therefore desired that the present embodiment be considered in all aspects as illustrative and not restrictive. Any headings utilized in the description are for convenience only and no legal or limiting effect. Numerous objects, features, and advantages of the embodiments set forth herein will be readily apparent to those skilled in the art upon reading of the following disclosure when taken in conjunction with the accompanying drawings.

BRIEF DESCRIPTION OF THE DRAWINGS

Hereinafter, various exemplary embodiments of the disclosure are illustrated in more detail with reference to the drawings.

DETAILED DESCRIPTION

Figure 1A:
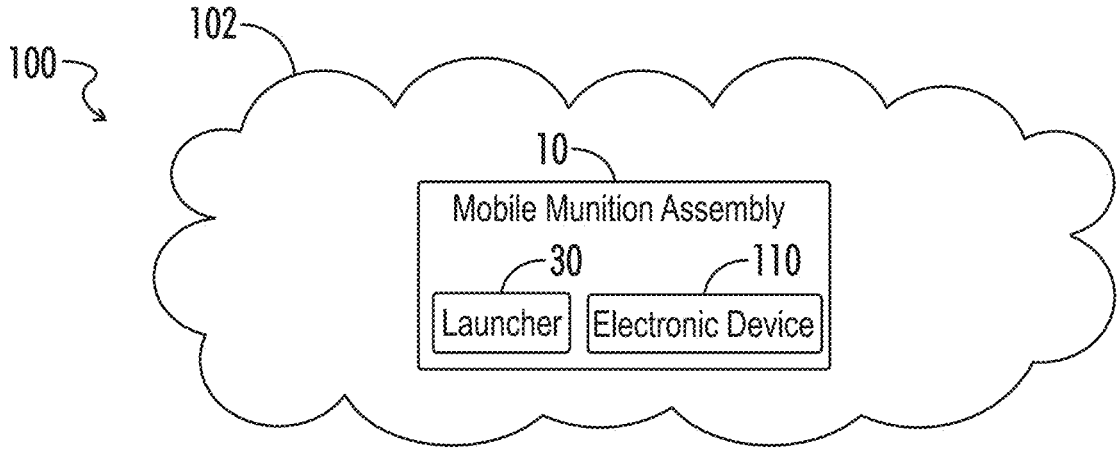
FIGS. 1A-1C illustrate exemplary embodiments of a partial diagram of a system for executing a mission for at least one mobile munition assembly, the system comprising one or more electronic devices in communicative coupling to, and in association with, one another, in accordance with aspects of the present disclosure.

Reference will now be made in detail to embodiments of the present disclosure, one or more drawings of which are set forth herein. Each drawing is provided by way of explanation of the present disclosure and is not a limitation. In fact, it will be apparent to those skilled in the art that various modifications and variations can be made to the teachings of the present disclosure without departing from the scope of the disclosure. For instance, features illustrated or described as part of one embodiment can be used with another embodiment to yield a still further embodiment.

Thus, it is intended that the present disclosure covers such modifications and variations as come within the scope of the appended claims and their equivalents. Other objects, features, and aspects of the present disclosure are disclosed in, or are obvious from, the following detailed description. It is to be understood by one of ordinary skill in the art that the present discussion is a description of exemplary embodiments only and is not intended as limiting the broader aspects of the present disclosure. Referring generally to FIGS. 1-14, various exemplary embodiments may now be described of apparatuses, systems, and methods for authorizing and executing a mission for at least one mobile munition assembly 10. Various embodiments may now be described of the mobile munition assembly 10, or one or more mobile munition assemblies 10, and methods and systems of implementation thereof, including a mission authorization and execution system 100. Specifically, various embodiments may now be described of the mobile munition assembly 10, the mission authorization and execution system 100, and a method 200 of executing a mission for at least one mobile munition assembly 10 in a mission environment 90. Where the various figures describe embodiments sharing various common elements and features with other embodiments, similar elements and features are given the same reference numerals and redundant description thereof may be omitted below.

Figure 1B:
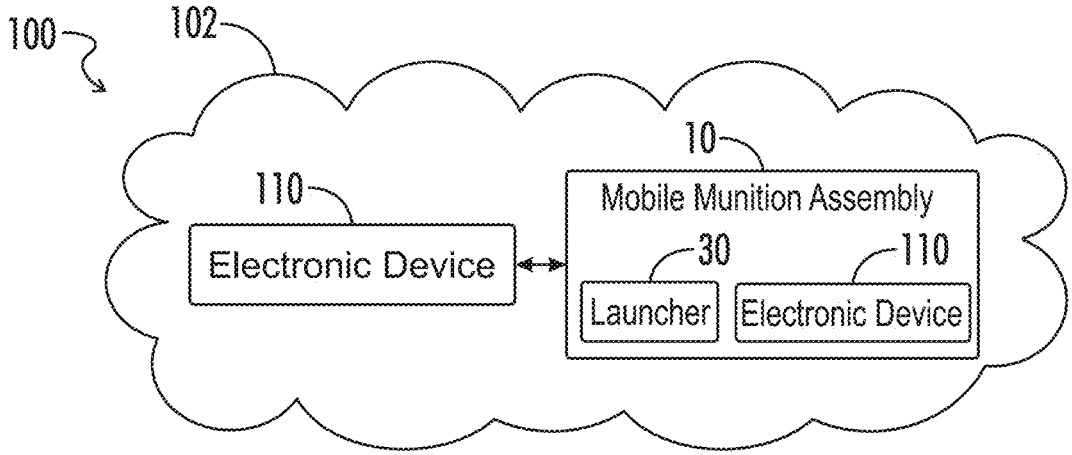
Figure 1C:
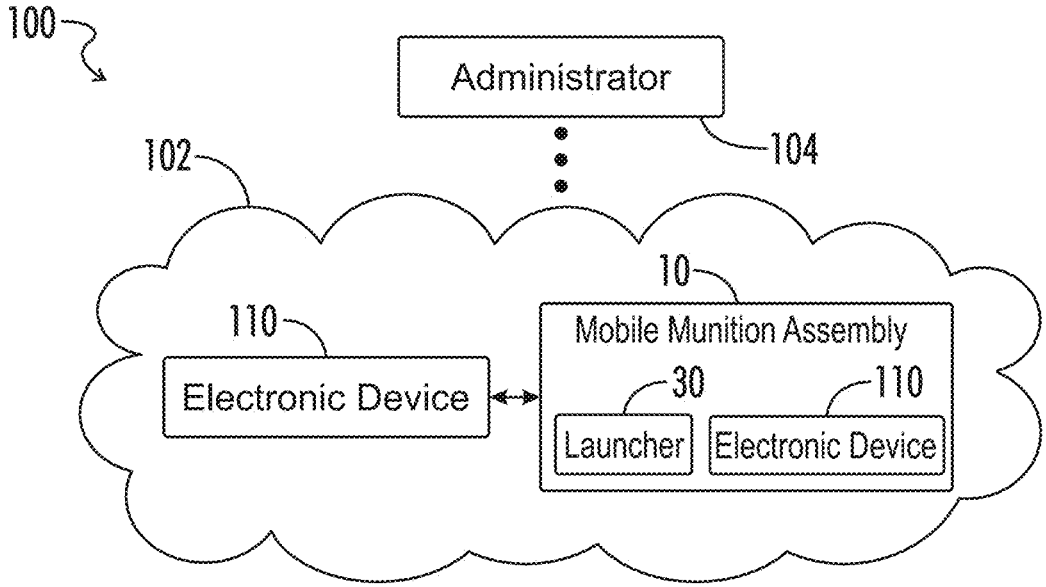

FIGS. 1A-1C illustrate an exemplary embodiment of a partial diagram of the system 100 for authorizing and executing a mission for at least one mobile munition assembly 10, the mission authorization and execution system 100 comprising one or more electronic devices 110. The one or more electronic devices 110, such as one or more user devices 110, may be associated with one or more of at least one mobile munition assembly 10, the at least one mobile munition assembly 10 having one or more launchers 30 configured to launch a munition 70 from a surface 97 of a launch terrain 96 into an airspace, and subsequently onto or against one or more targetable assets 92 in the mission environment 90, as illustratively conveyed in FIGS. 11-12.

Referring to FIG. 1A, the system 100 may comprise one of one or more electronic devices 110, the one of the one or more electronic devices 110 in association with the at least one mobile munition assembly 10, and the one or more electronic devices 110 establishing a secure network 102. The secure network 102 may comprise a closed network 102 comprising only the one of the one or more electronic devices 110, the closed network 102 having the capability of recruiting and/or accepting another of the one or more electronic devices 110 into the closed network 102, such as by and through authentication keys or access credentials inputted vis-à-vis a user interface (UI) on a display unit 117.

Referring to FIG. 1B, the system 100 may comprise a plurality of the one or more electronic devices 110, wherein at least one of the one or more electronic devices 10 is associated with one or more of the at least one mobile munition assembly 10. The plurality of the one or more electronic devices 110 may be communicatively coupled to one another vis-à-vis a communication unit 114 (as further described herein), such that each of the one or more electronic devices 110 are in communicative association with one another. The plurality of the one or more electronic devices 110 may establish, or form, the secure network 102 when the one or more electronic devices 110 are communicatively coupled to, and in association with, one another.

Referring to FIG. 1C, the system 100 may comprise a plurality of the one or more electronic devices 110, wherein at least one of the one or more electronic devices 110 is associated with the one or more of the at least one mobile munition assembly 10. The one or more electronic devices 110 communicatively coupled to, and in association with, one another may be recruited or accepted to the secure network 102 by an administrator 104. The administrator 104 may comprise another of the one or more electronic devices 110, or the administrator 104 may comprise a server, a centralized host, or the like, capable of providing and/or maintaining the secure network 102 for the one or more electronic devices 110. For the purpose of the disclosure herein, the system 100 may authorize the mission for the at least one mobile munition assembly 10 vis-à-vis any (one or more) of the one or more electronic devices 110 or the administrator 104, and combinations thereof.

Figure 1D:
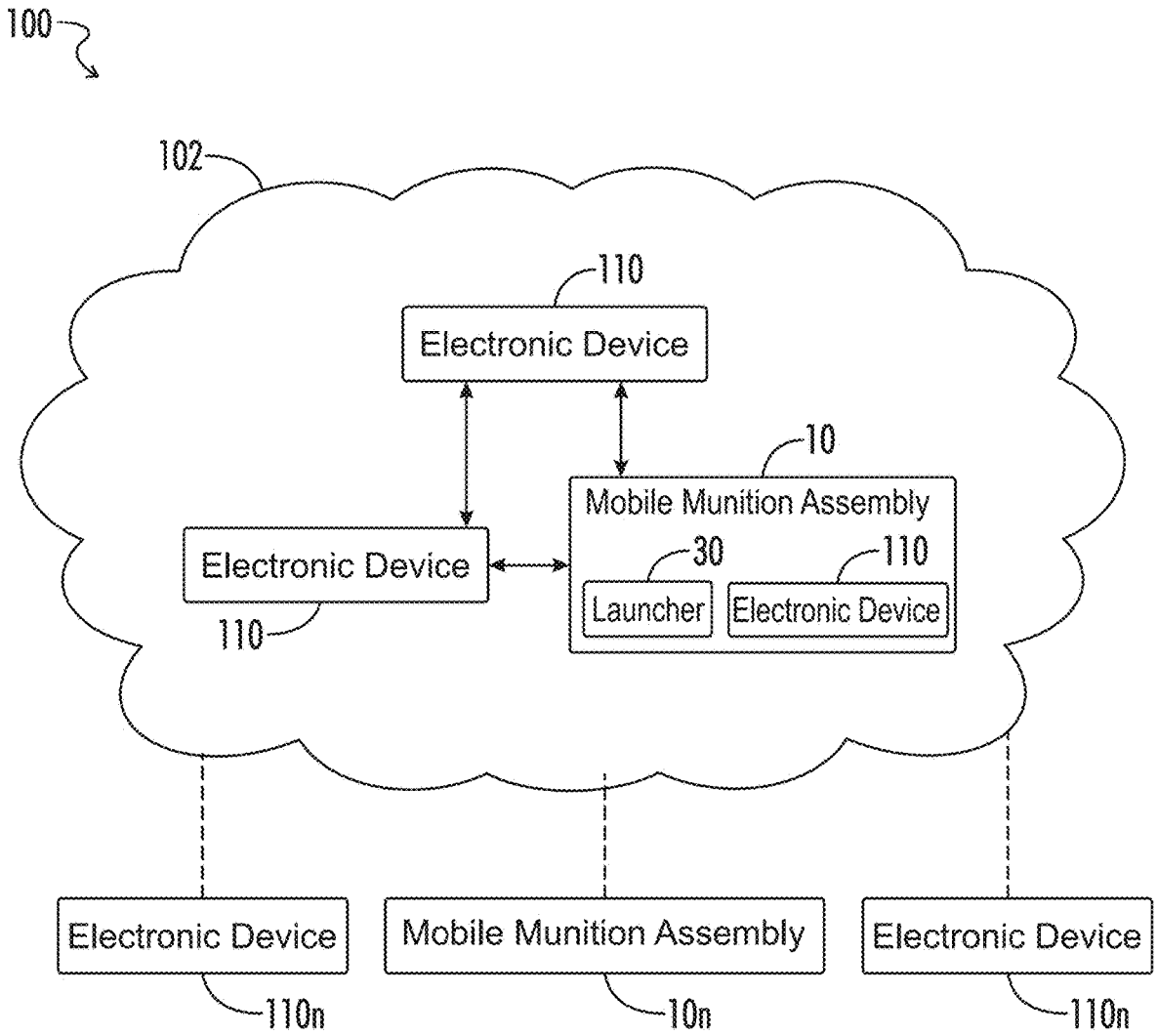
FIG. 1D illustrates an exemplary embodiment of a partial network diagram of a system for executing a mission for at least one mobile munition assembly, in accordance with aspects of the present disclosure.

FIG. 1D illustrates an exemplary embodiment of a partial network diagram of the system 100 for authorizing the mission for at least one mobile munition assembly 10. The system 100 may comprise a plurality of the one or more electronic devices 110 communicatively coupled to, and in association with one another, wherein at least one of the one or more electronic devices 110 is associated with one or more of the at least one mobile munition assembly 10. The communicatively coupling and association of the one or more electronic devices 110 may form, or establish, the secure network 102, including by and through wired or wireless communication (e.g., cellular communication). The secure network 102 may be configured to recruit other of the one or more electronic devices 110*n*, whether by and through any of the one or more electronic devices 110 or through the administrator 104, or a combination of the foregoing. One or more of the at least one mobile munition assembly 10*n* may be associated with any (one or more) of the one or more electronic devices 110*n* recruited to the secure network 102.

Figure 5:
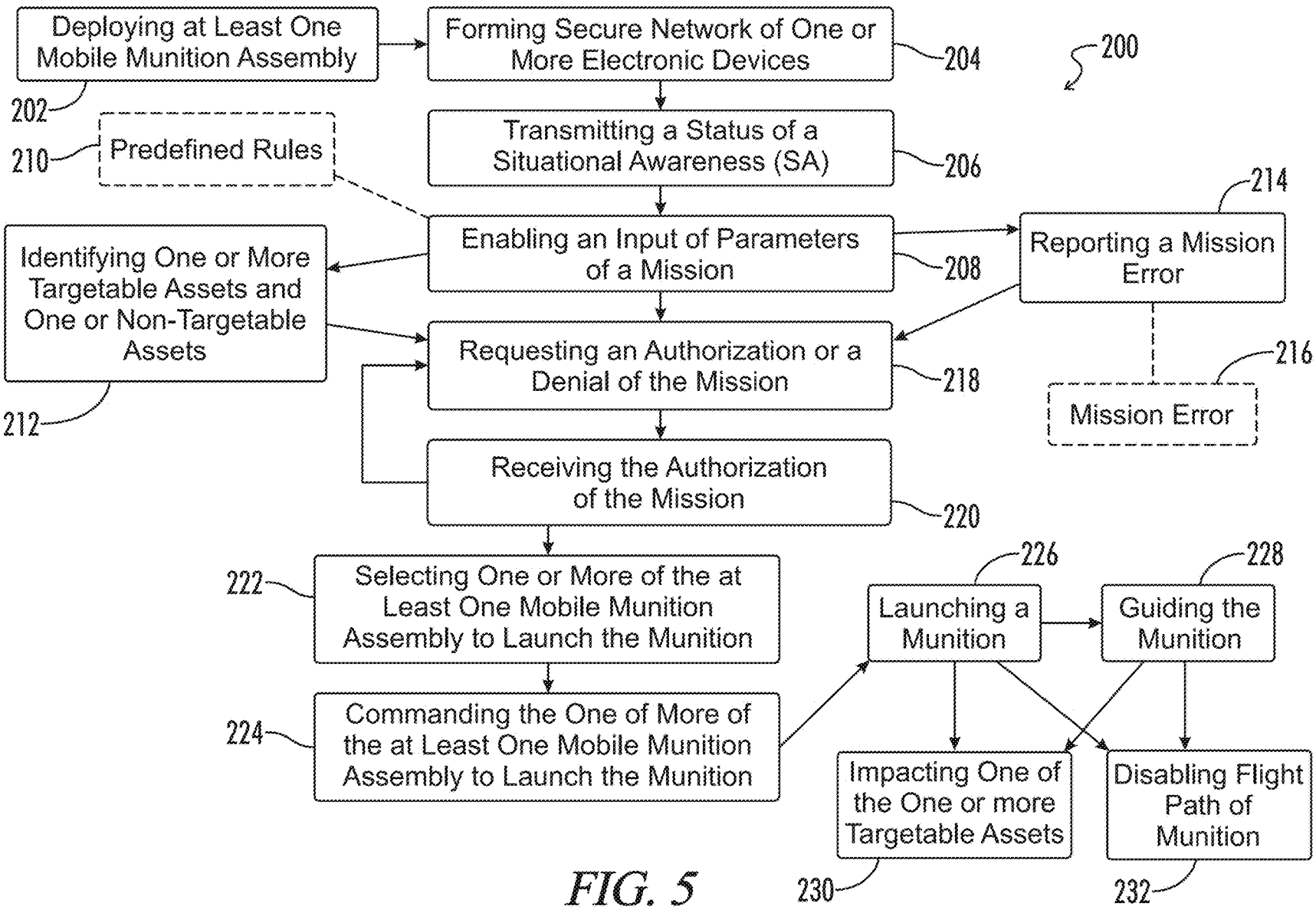
FIG. 5 illustrates a flowchart providing an exemplary embodiment of a method for executing a mission for at least one mobile munition assembly, in accordance with aspects of the present disclosure.
Figure 8:
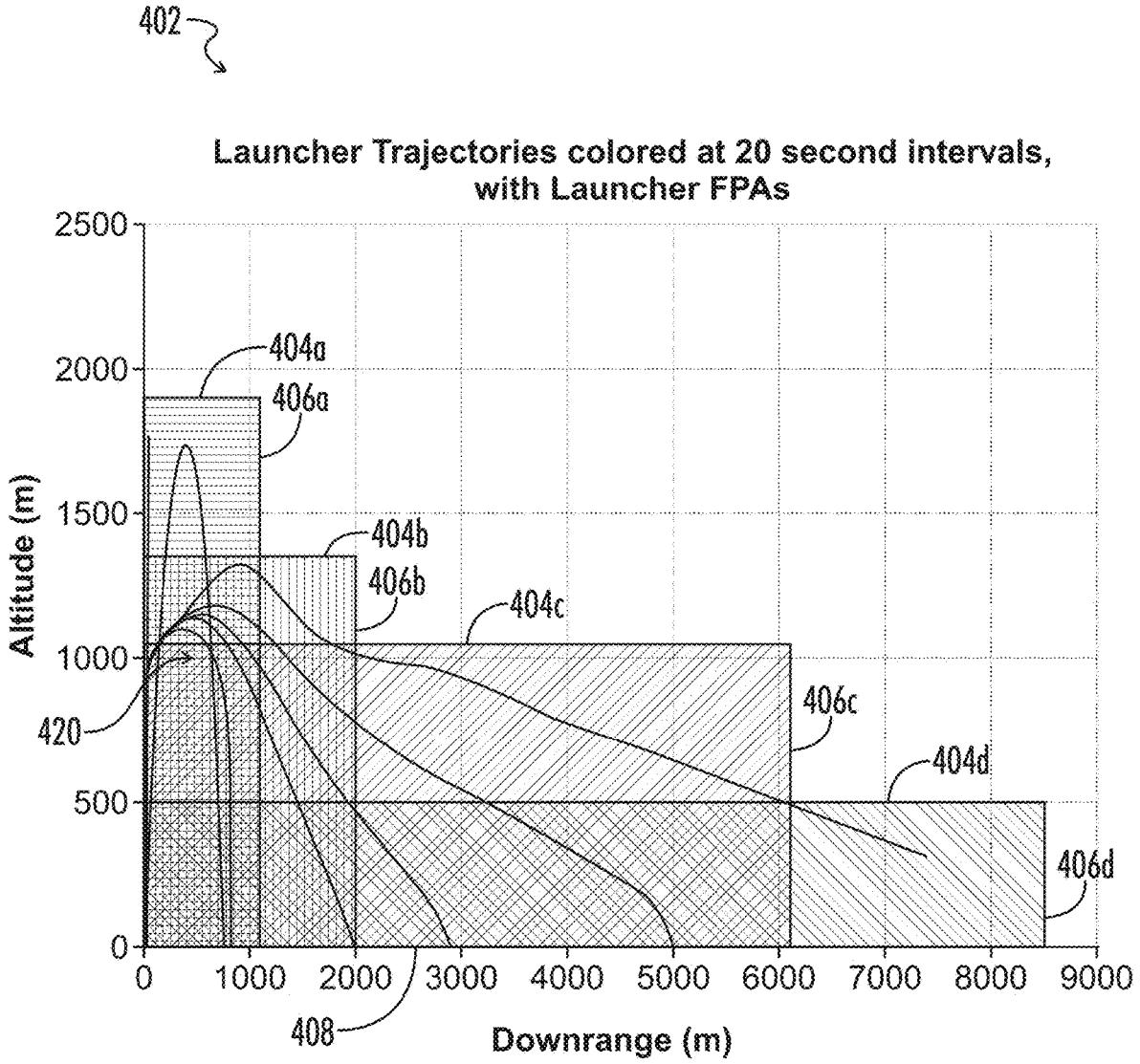
FIG. 8 illustrates an exemplary embodiment of a determination of a future position area of a portable launch assembly, in accordance with aspects of the present disclosure.
Figure 9:
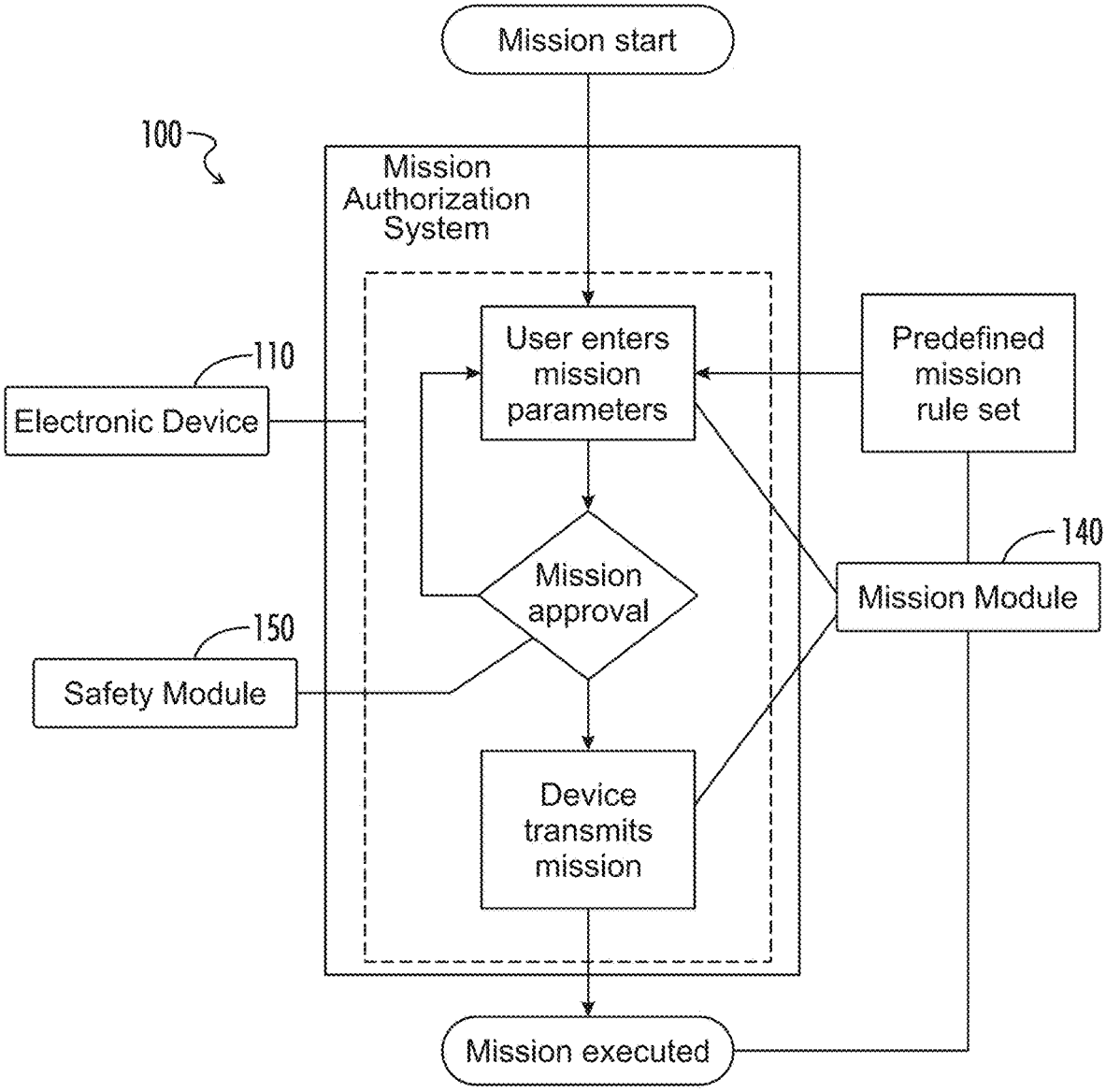
FIG. 9 illustrates an exemplary embodiment of a partial block diagram of a system for executing a mission for at least one mobile munition assembly, the system comprising one or more electronic devices having a safety module and a mission module, in accordance with aspects of the present disclosure.

As depicted in FIGS. 1A-1D, the system 100 may comprise the one or more electronic devices 110 communicatively coupled to, and in association with, one another in a given area, such as the mission environment 90 (as exemplarily illustrated in FIGS. 8-9). Within the secure network 102, the one or more electronic devices 110 of the system 100 may function in accordance with the method 200, as depicted in FIG. 5 and as discussed further herein, either alone (e.g., independently), or in concert with one another, such that the one or more electronic devices 110 of the system 100 may function as decentralized or distributed nodes in the secure network 102. Where the one or more electronic devices 110 act in concert with one another, each of the one or more electronic devices 110 may act as nodes to relay, transmit, and/or exchange communications, inputs (e.g., mission parameters), or data among the one or more electronic devices 110 in the system 100.

As shown in FIGS. 1A-1D, directional arrows convey the communicative couplings, and associations, of the one or more electronic devices 110 of the system 100, wherein at least one of the one or more electronic devices 110 is associated with one or more of the at least one mobile munition assembly 10.

In optional embodiments of the system 100, each of the one or more electronic devices 110 may be communicatively coupled to, and in association with, one another, as well as the administrator 104. The administrator 104 may comprise another network of devices, such as another of the secure network 102, or the administrator 104 may include a master administrator with one or more slave administrators, wherein each of the master administrator or the one or more slave administrators may be communicatively coupled to, and in association with, the one or more electronic devices 110.

In other optional embodiments, the secure network 102 may comprise a mobile ad-hoc network (MANET) or a wireless mesh network (WMN). In embodiments where the secure network 102 comprises a mobile ad-hoc network (MANET) or a wireless mesh network (WMN), the one or more electronic devices 110 may be communicatively coupled to, and in association with, one another based upon geographical or physical proximity within the mission environment 90. Other of the one or more electronic devices 110, one of which may be associated with one or more of the at least one mobile munition assembly 10, may be recruited or accepted by the secure network 102 when the one or more electronic devices 110 are moved within a geographical proximity or physical range of the then-existing secure network 102 of the one or more electronic devices 110.

Figure 2A:
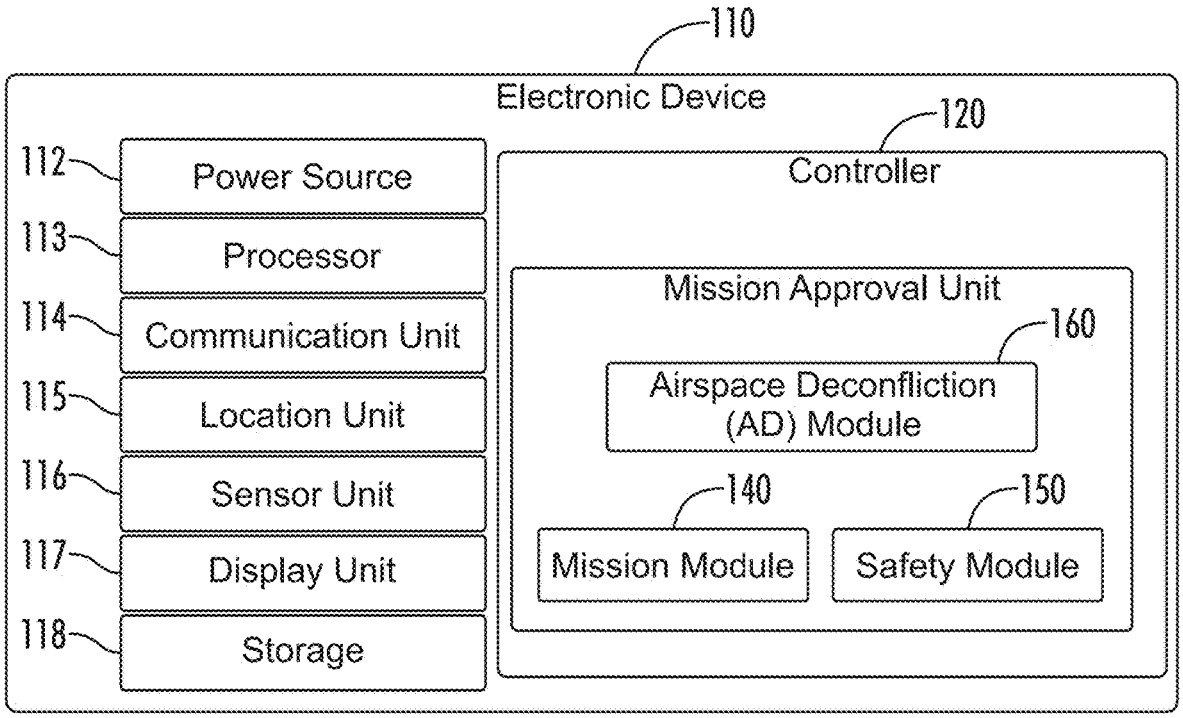
FIG. 2A illustrates an exemplary embodiment of a partial block diagram of an electronic device, in accordance with aspects of the present disclosure.
Figure 2B:
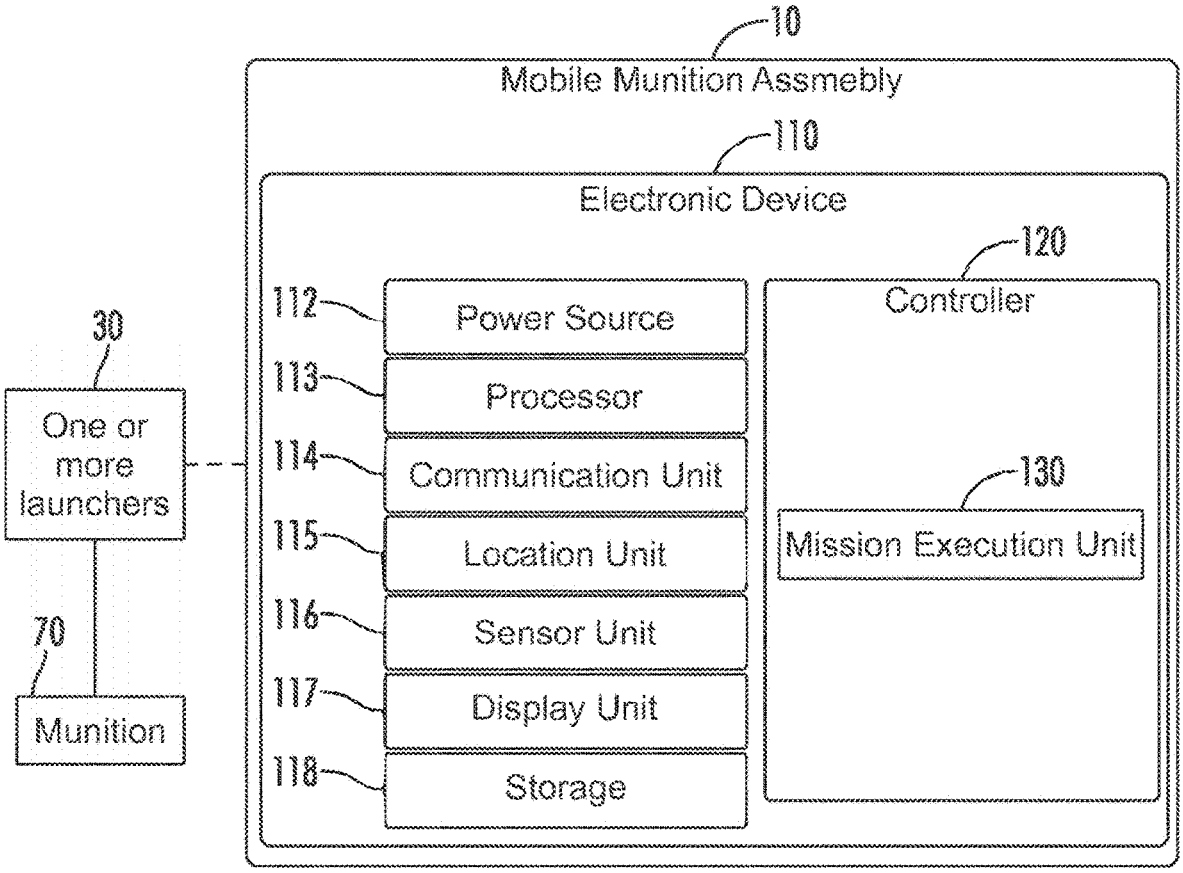
FIG. 2B illustrates an exemplary embodiment of a partial block diagram of the electronic device in association with a mobile munition assembly, in accordance with aspects of the present disclosure.

FIGS. 2A-2B depict an exemplary embodiment of the electronic device 110, wherein one of the one or more electronic devices 110 may be associated with at least one mobile munition assembly 10 having one or more launchers 30 configured to launch the munition 70. Any of the one or more electronic devices 110 may be lightweight, portable, and/or rugged, and may preferably be a hand-held computer, such as a personal data assistant (PDA), cellular phone, or a smart cellular device, including a smart cellular device or portable computer employing an Android-based operating system (OS), an Apple-based OS, or a Linux-based OS.

In optional embodiments, any of the one or more electronic devices 110 may be portable laptop computer, or a notebook- or tablet-type computer. The one or more electronic devices 110 may include one or more of a power source 112, a processor 113, a communication unit 114, a location unit 115, a sensor unit 116, the display unit 117, a storage (or a storage medium) 118, and a controller 120 configured to execute a mission execution unit 130. The power source 112, which drives operability of the one or more electronic devices 110, may include at least one of a modular battery, a battery backup, an uninterrupted power supply (UPS), or any battery commercially provided in connection with a smart cellular device or portable computer employing an Apple-based OS, an Android-based OS, or a Linux-based OS, or the like. The processor 113 may be a generic hardware processor, a special-purpose hardware processor, or a combination thereof. In embodiments having a generic hardware processor (e.g., as a central processing unit (CPU) available from manufacturers such as Intel and AMD), the generic hardware processor is configured to be converted to a special-purpose processor by means of being programmed to execute and/or by executing a particular algorithm in the manner discussed herein, e.g., the method 200, for providing a specific operation or result. It should be appreciated that the processor 113 may be any type of hardware and/or software processor and is not strictly limited to a microprocessor or any operation(s) only capable of execution by a microprocessor, in whole or in part.

The communication unit 114 of the one or more electronic devices 110 may be configured to permit communication—for example via the secure network 102, as depicted in FIGS. 1A-1D—by a wired interface, wireless interface, or a combination thereof.

In optional embodiments, the communication unit 114 may include wireless communication components, such as cellular modem, radio waves, Wi-Fi, or Bluetooth, and combinations thereof.

In other embodiments, the communication unit 114 may include a transceiver (not shown), or other two-way radio, which may be functionally linked to the controller 120, the transceiver (not shown) configured to send and receive communications vis-à-vis radio waves, such as among the one or more electronic devices 110 or between the one or more electronic devices 110 and a communication section (not shown) associated with the one or more launchers 30 of the at least one mobile munition assembly 10.

In optional embodiments, the transceiver (not shown), or the two-way radio, may be a single channel ground/airborne radio system (SINCGARS) or advanced systems improvement program (ASIP) radio with external antenna.

The communication unit 114 may enable the one or more electronic devices 110 to communicatively couple to, and associate with, one another, or in optional embodiments, the administrator 104. The communication unit 114 may also be functionally communicable with other aspects of the one or more electronic devices 110, including the location unit 115 and the sensor unit 116. In optional embodiments, the communication unit 114 of the one or more electronic devices 110 may include a radio-frequency (RF) unit, which may comprise an antenna configured to transmit single- or multi-directional signals to other RF units in the communication unit 114 of the other of the one or more electronic devices 110.

The location unit 115 of the one or more electronic devices 110 may include a global positioning system (GPS) unit (not shown), the GPS unit (not shown) configured to provide location data of at least one of the one or more electronic devices 110, the at least one mobile munition assembly 10, or the munition 70, wherein one of the one or more electronic devices 10 is associated therewith. In optional embodiments, the location unit 115 of the one or more electronic devices 110 may include an inertial guidance system (IGS) unit (not shown), the IGS unit (not shown) configured to provide information from sensors, such as inertial measurement units (IMUs), to a controller 120 of the one or more electronic devices 110 such that the controller 120 may determine the location of the at least one of the one or more electronic devices 110, the at least one mobile munition assembly 10, or the munition 70. Such location data may correspond to position location information (PLI) and/or position vector information (PVI) of the one or more electronic devices 110, particularly the PLI and/or PVI of the one or more electronic devices 110 in the mission environment 90.

The sensor unit 116 of the one or more electronic devices 110 may comprise a number of sensors, such as inertial measurement units (IMUs). In optional embodiments, the IMUs may include a number of sensors including, but not limited to, accelerometers, which measure (among other things) velocity and acceleration, gyroscopes, which measure (among other things) angular velocity and angular acceleration, and magnetometers, which measure (among other things) strength and direction of a magnetic field. In optional embodiments, the IMUs may also include any number of a temperature sensor, a shock or impact sensor, a photodetector, an electrostatic sensor, an air pressure sensor, or a clock, timer, or sensor otherwise used to measure elapsed or absolute time. In optional embodiments, directional data provided by the location unit 115, or position-based data provided by the sensor unit 116, may be merged (or otherwise used in combination) by the controller 120 to ascertain a location or motion of the one or more electronic devices 110 (and any of the at least one mobile munition assembly 10 associated therewith) in the mission environment 90.

The one or more electronic devices 10 may store one or more sets of instructions, including instructions corresponding to the method 200, in the storage 118, which may be either volatile or non-volatile. The one or more sets of instructions, including instructions corresponding to the method 200, may be configured to be executed by the processor 113 to perform at least one operation corresponding to the one or more sets of instructions. The one or more electronic devices 110 may also have a display unit 117 as part of a user interface (UI), which may include one or more UI tools, such as a keyboard, keypad, joystick, toggle, touchscreen, or other tool, which are configured to enable input of instructions to the controller 120, including parameters of the mission, as further described herein.

The one or more electronic devices 110 may comprise a standalone device (as described previously) or may be used with at least one external component, such as another of the one or more electronic devices 110 or the administrator 104, either locally or remotely communicatively couplable with the one or more electronic devices 110—for example via the secure network 102, as depicted in FIGS. 1A-1D. The one or more electronic devices 110 may be configured to store, access, or provide at least a portion of information usable to permit one or more operations described herein, including operations set forth in the method 200, and as illustratively conveyed in FIGS. 5 and 9-10. Alternatively, or in addition, the one or more electronic devices 110 may be configured to store content data and/or metadata to enable one or more operations described herein.

Figure 3A:
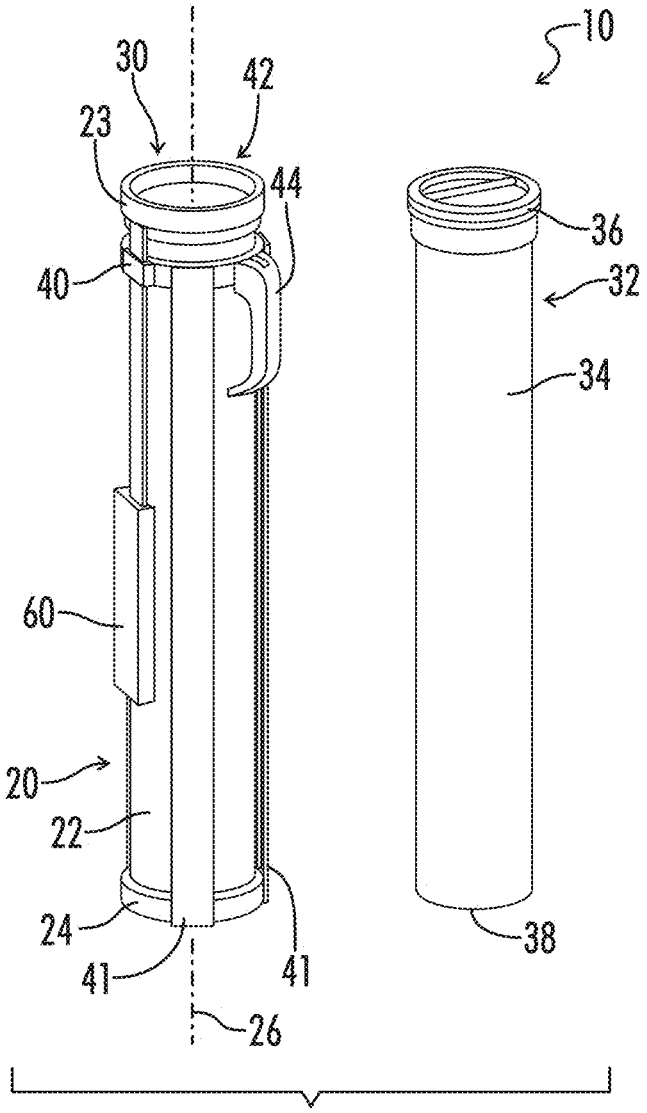
FIGS. 3A-3B illustrate perspective views of an exemplary embodiment of a mobile munition assembly, where a stabilizer is operated in a first configuration and a second configuration, in accordance with aspects of the present disclosure.
Figure 3B:
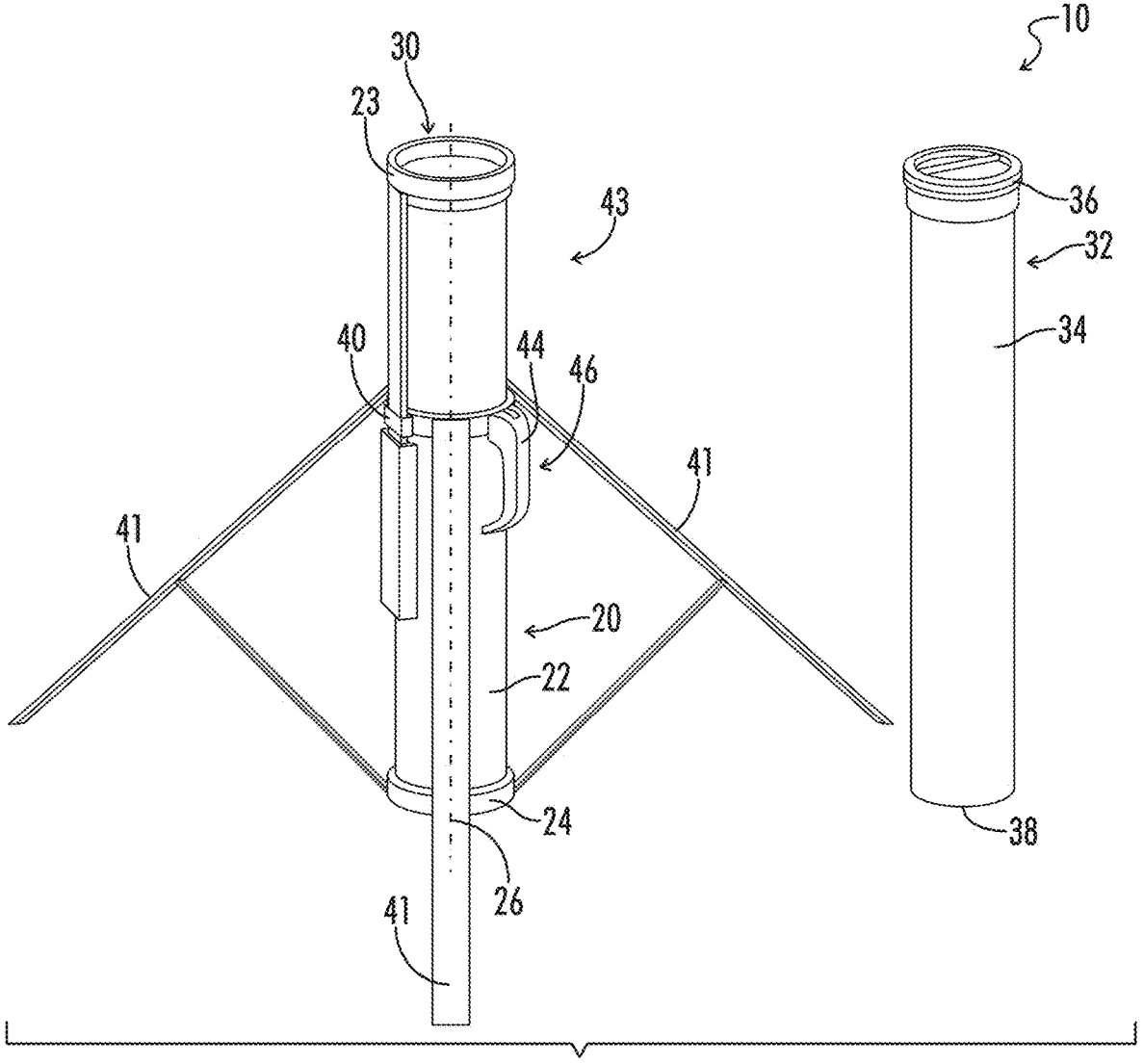

FIGS. 3A-3B illustrate perspective views of an exemplary embodiment of the mobile munition assembly 10 in the form of a manpack. The mobile munition assembly 10 may have a container 20 and a stabilizer 40. A container frame 22 of the container 20, which generally defines an exterior of the container 20, may have a first end 23 distally located from a second end 24. The container 20 may have a length defined from the first end 23 to the second end 24 of the container frame 22, the length ranging up to about sixty (60) inches, though in other embodiments the length may be greater than the foregoing. The container 20 may be formed by a material including at least one of steel, aluminum, titanium, nickel, and other metals and metallic alloys, as well as composite-based or polymer-based materials, including fiber reinforced plastic (FRP), polyvinyl chloride (PVC), and combinations thereof. The container frame 22 may enclose one or more launchers 30. Each of the one or more launchers 30 may be configured to receive a munition receptacle 32. In optional embodiments, the mobile munition assembly 10 may include or otherwise have one or more of the container 20 with a corresponding one or more of the container frame 22.

Figure 4:
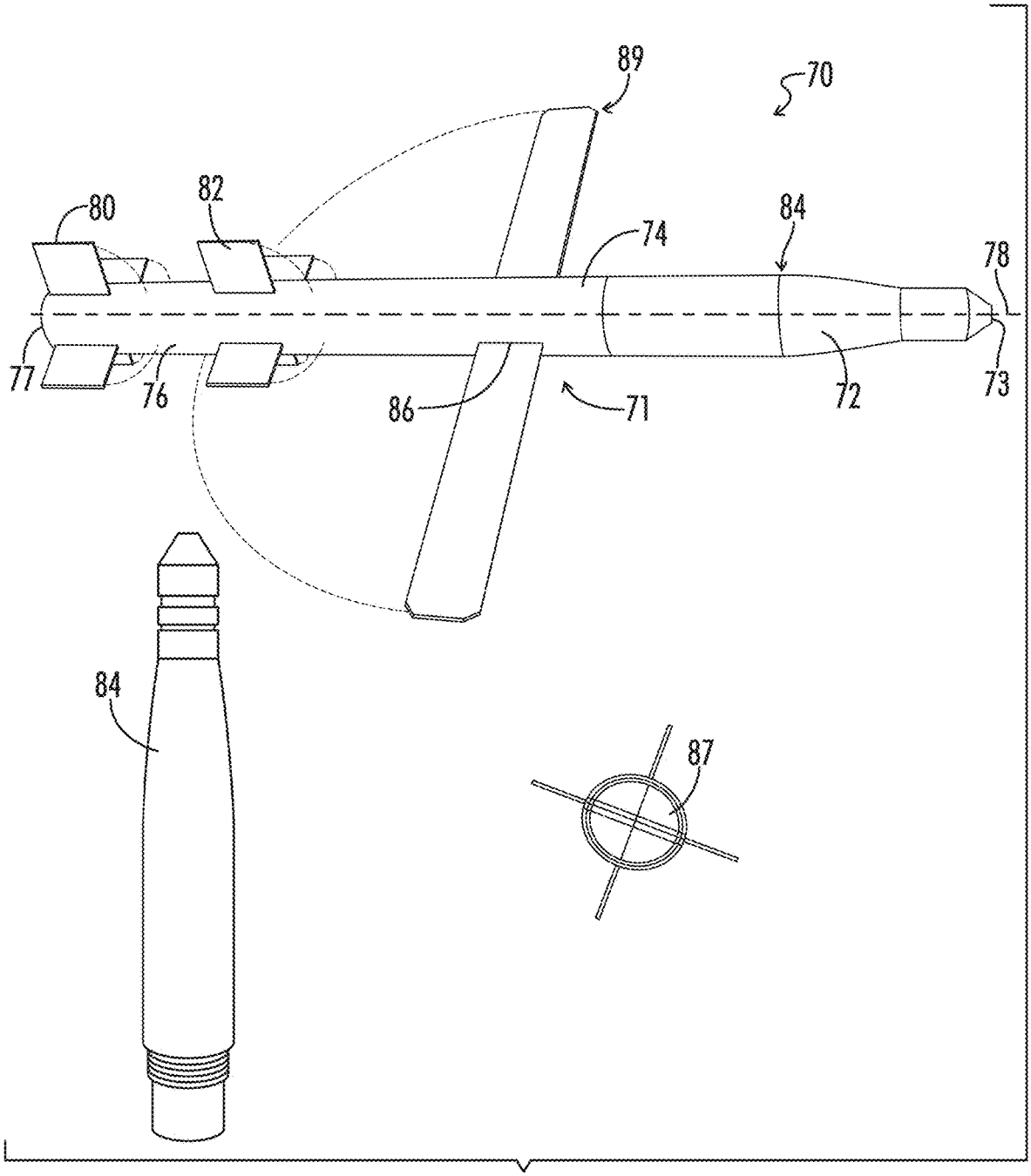
FIG. 4 illustrates a perspective view of an exemplary embodiment of a munition, in accordance with aspects of the present disclosure.

The munition receptacle 32 may be capable of receiving the munition 70, as illustratively conveyed in FIG. 4. The munition receptacle 32 may be formed by a material including at least one of a high-pressure laminate, high-pressure laminate with a phenolic resin formulation or other flame-retardant additive, steel, such as maraging or stainless steel, aluminum, titanium, or other metals and metallic alloys, as well as composite-based or polymer-based materials, or other pyrotechnic materials, and combinations thereof. In optional embodiments, the munition receptacle 32 may include a receptacle frame 34. The receptacle frame 34 may have a top end 36 and a bottom end 38, the top end 36 distally located from the bottom end 38. The top end 36 may correspond to the first end 23 of the container frame 22 and the bottom end 38 may correspond to the second end 24 of the container frame 22. The receptacle frame 34 may taper beginning from the top end 36 to the bottom end 38, thereby rendering the receptacle frame 34 seamlessly and/or slidably removable from the container 20. In further optional embodiments, one or more receptacle holes (not shown) may be disposed on about the receptacle frame 34 and corresponding to one or more container holes (not shown) disposed on and about the container frame 22. Each of the corresponding one or more receptacle holes (not shown) and the one or more container holes may receive a threaded fastener (not shown) to secure the container 20 to the munition receptacle 32.

In other embodiments of the munition receptacle 32, the munition receptable 32 may have a receptacle handle (not shown) supported from the receptacle frame 34. The receptacle handle (not shown) may be pivotable between a collapsed position and an extended position. In the extended position, the receptacle handle (not shown) may be pivoted away from the receptacle frame 34; and, in the collapsed position, the receptacle handle (not shown) may be folded up adjacent to the receptacle frame 34. In optional embodiments, a hinge may be configured to allow pivotable movement of the receptacle handle (not shown) relative to the receptacle frame 34. In further optional embodiments, a spring (not shown) may be configured to bias the receptacle handle (not shown) to the extended position.

Referring to FIGS. 3A-3B, the stabilizer 40 may be supported from the container frame 22. The stabilizer 40 may include a plurality of pivotable legs 41. The stabilizer 40 may be operable between a first configuration 42 and a second configuration 43. In the first configuration 42, the plurality of pivotable legs 41 may be folded up adjacent to the container frame 22; and, in the second configuration 43, the plurality of pivotable legs 41 may be pivoted away from the container frame 22. Where the stabilizer 40 is operated to the second configuration 43, the container 20 may be placed in an upright position, such that an axis 26 from the first end 23 to the second end 24 of the container frame 22 may be generally orthogonal to a surface 97 of a launch terrain 96, as illustratively conveyed in FIGS. 11-12. In optional embodiments, where the stabilizer 40 is operated to the second configuration 43, the container may be placed in a semi-upright position, such that the axis 26 from the first end 23 to the second end 24 may form an angle relative to the surface 97 of the launch terrain 96, ranging from between about 30 degrees to 90 degrees. By placing the container 20 generally orthogonal to the surface 97 of the launch terrain 96, however, the mobile munition assembly 10 need not be positioned or displaced at an angle relative to the surface 97 of the launch terrain 96, thereby increasing the speed and efficiency in a deployment of the mobile munition assembly 10. The launch terrain 96 may include any number of environmental or geographical terrains, lands, grounds, or landscapes, as well as any artificial or man-made structure, including vehicles or heavy equipment or machinery.

Referring to FIGS. 3A-3B, a stabilizer handle 44 may be attached to the stabilizer 40. The stabilizer handle 44 may be configured to operate the stabilizer 40 between the first configuration 42 and the second configuration 43. The stabilizer 40 may be operated to the first configuration 44 by moving the stabilizer handle 44 proximate to the first end 23 of the container frame 22. The stabilizer 40 may be operated to the second configuration 43 by moving the stabilizer handle 44 to an intermediate location 46 between the first end 23 and the second end 24 of the container frame 22. In optional embodiments, the intermediate location 46 of the stabilizer handle 44 may be generally equidistant from the first end 23 to the second end 24 of the container frame 22.

Figure 3C:
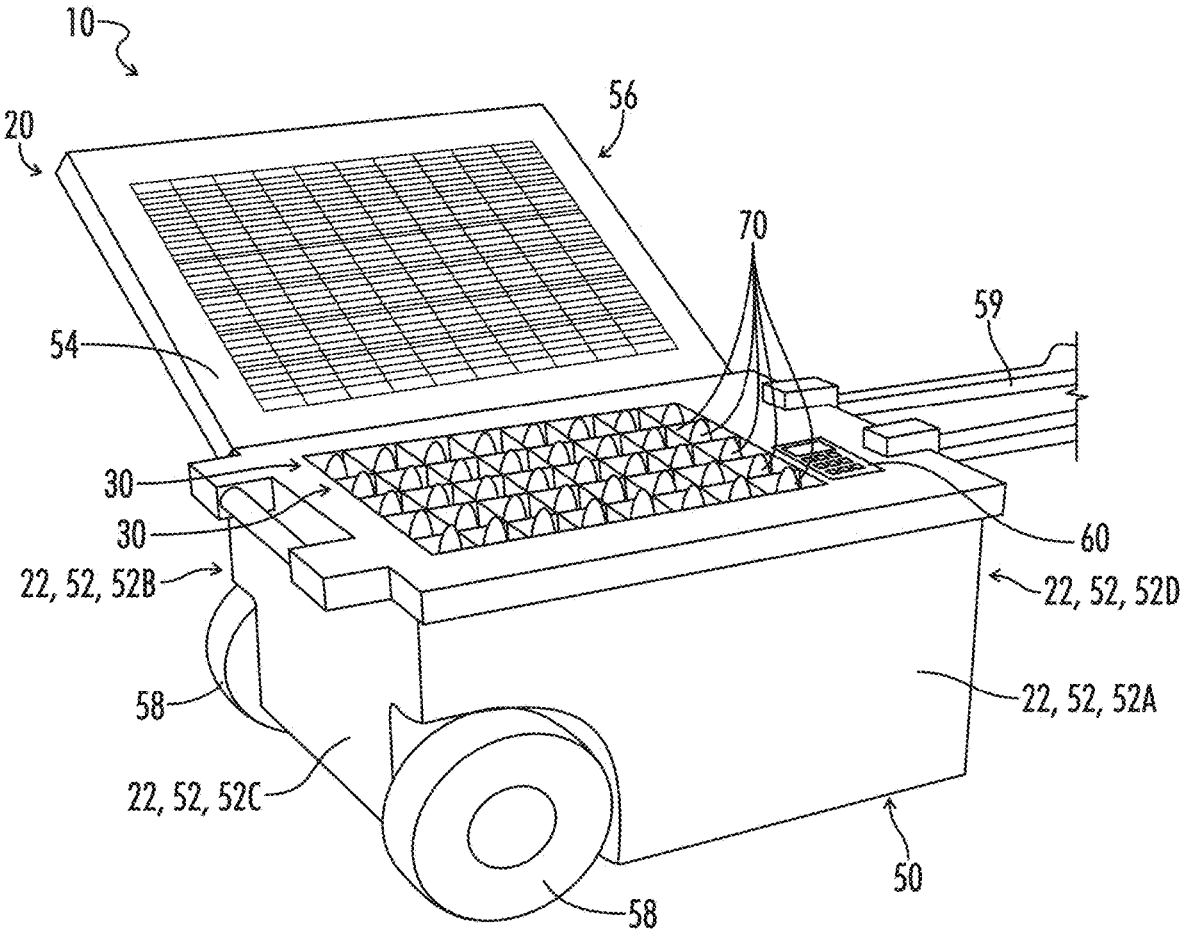
FIG. 3C illustrates a perspective view of another embodiment of the mobile munition assembly, wherein a lid of a container is operated in an open configuration, in accordance with aspects of the present disclosure.

FIG. 3C illustrates a perspective view of another embodiment of the mobile munition assembly 10. In this embodiment, the mobile munition assembly 10 may include the container 22, the container 22 of which includes peripheral walls 52—such as a front peripheral wall 52A, a back peripheral wall 52B, a left peripheral wall 52C, and a right peripheral wall 52D—a bottom 50, and a lid 54. The peripheral walls 52 may extend from the bottom 50 to define an interior of the mobile munition assembly 10—the peripheral walls 52 defining the container frame 22 in this embodiment. The one or more launchers 30 may be housed within the container frame 22, where the one or more launchers 30 are capable of receiving one or more munition 70. The lid 54 may be movable between a collapsed configuration (not depicted), wherein the lid 54 is engaged against the peripheral walls 52 to otherwise seal the interior of the container frame 22, and an open configuration 56, wherein the lid 54 is pivoted away from the peripheral walls 52 to expose the one or more launchers 30 (and the one or more munitions 70 received therein). Supported from the peripheral walls 52 and/or the bottom 50 may be one or more track units 58, such as wheels, crawlers, or other units, capable of moving the mobile unition assembly 10 across the surface 97 of the launch terrain 96. The mobile munition assembly 10 may be movable across the surface 97 of the launch terrain 96 where a user grabs or grips a handle 59 attached to the peripheral wall 52, which may be used in conjunction with the track units 58 to portably move the munition assembly 10 across the mission environment 90. When placed atop the surface 97 of the launch terrain 96, the container 22 may be configured in an upright position, such that an axis defined through each of the munition 70 received in the one or more launchers 30 (or an axis defined through each of the one or more munition receptacles 30 (not depicted) disposed within the container frame 22) may be generally orthogonal to the surface 97 of the launch terrain 96, thereby enabling a vertical launch of the munition 70 from the surface 97.

Figure 3D:
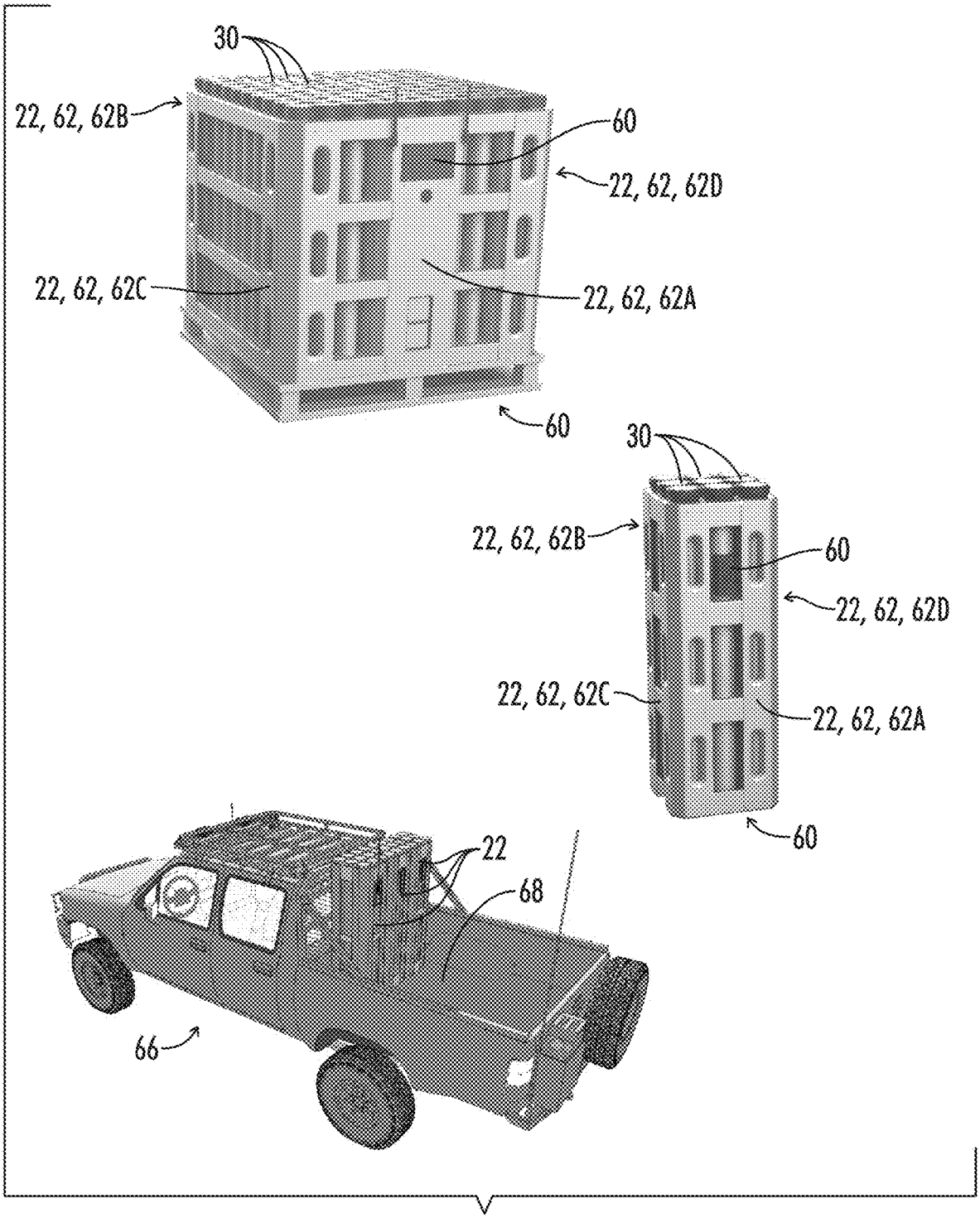
FIG. 3D illustrates a perspective view of another embodiment of the mobile munition assembly 10 in the form of a vehicle module and/or a stationary module, in accordance with aspects of the present disclosure.

FIG. 3D illustrates a perspective view of another embodiment of the mobile munition assembly 10 in the form of a vehicle module and/or a stationary module. In this embodiment, the mobile munition assembly 10 may include the container 22, the container 22 of which includes peripheral walls 62—such as a front peripheral wall 62A, a back peripheral wall 62B, a left peripheral wall 62C, and a right peripheral wall 62D—and a bottom 64. The peripheral walls 62 may extend from the bottom 60 to define an interior of the mobile munition assembly 10—the peripheral walls 62 defining the container frame 22 in this embodiment. The one or more launchers 30 may be housed within the container frame 22, where the one or more launchers 30 are capable of receiving one or more munition 70. The mobile munition assembly 10 may be provided on a transportable surface, such as a cargo surface 68 of a vehicle 66. In an exemplary embodiment as depicted in FIG. 3D, a number of container frames 22 may be mounted on the cargo surface 68 of a vehicle 66 for transportation by the vehicle 66. In optional embodiments, the mobile munition assembly 10 may be transported to the mission environment 90 and deposited at a stationary location where a bottom 64 of the container frame 22 may be placed on the surface 97 of the launch terrain 96. In an exemplary embodiment as depicted in FIG. 3D, a stationary module of a container frame, including a number of launchers 30, may service for long term placement of the mobile munition assembly 10 within a mission environment 90. The container frame 22 may include a number of launchers 30, including up to nine (9) launchers in some embodiments and up to 100 launchers in other embodiments as illustratively conveyed in FIG. 3D. When placed atop the surface 97 of the launch terrain 96, the container 22 may be configured in an upright position, such that an axis defined through each of the munition 70 received in the one or more launchers 30 (or an axis defined through each of the one or more munition receptacles 30 (not depicted) disposed within the container frame 22) may be generally orthogonal to the surface 97 of the launch terrain 96, thereby enabling a vertical launch of the munition 70 from the surface 97.

In optional embodiments, the one or more launchers 30 of the at least on mobile munition system 10, in association with at least one of the one or more electronic devices 110, may include a controller (not shown) as part of a launcher device 60, as illustratively conveyed in FIGS. 3A-3D. The controller (not shown) may be associated with a processor (not shown), a computer readable medium (not shown), a data storage (not shown), and in optional embodiments a user interface (not shown) having a display (not shown).

In other optional embodiments, an input/output device (not shown), such as a keyboard, keypad, touchscreen, joystick, or other user interface tool, is provided so that a human user may input instructions to the controller (not shown) of the one or more launchers 30.

A communication unit (not shown) of the controller (not shown) of the one or more launchers 30 may support or provide communications between the controller (not shown) of the one or more launchers 30 and the one or more communication unit 114 of the one or more electronic devices 110. The communication unit (not shown) of the one or more launchers 30 may also a location unit (not shown) having a global positioning system (GPS) unit with an antenna, wherein the GPS unit may be configured to provide location data of the at least one mobile munition assembly 10 in the mission environment 90. An example of the GPS unit or receiver may be a defense advanced global positioning system receive (DAGR) with the antenna. The communication unit (not shown) of the one or more launchers 30, on the launcher device 60, may also include a transceiver (not depicted), or other two-way radio, which may be configured to send and receive communications vis-à-vis radio waves from other of the one or more launchers 30 or the one or more electronic devices 110. In optional embodiments, the transceiver (not shown) or the two-way radio, may be a single channel ground/airborne radio system (SINCGARS) or advanced systems improvement program (ASIP) radio with external antenna. Moreover, the one or more launchers 30 may be driven by a power supply (not shown), which may include at least one of a modular battery, a solar panel, a battery backup, an uninterrupted, power supply (UPS), or any combination thereof.

The controller (not shown) of the one or more launchers 30, through a central processing unit (not shown), may process data received from sensor units (not shown) associated within the one or more launchers 30, such as inertial measurement units (IMUs). The IMUs may be configured to provide output signals as to the relative position, velocity, and orientation of the one or more launchers 30, and by extension the container 20 of the mobile munition assembly 10. The IMUs may be associated with the controller (not shown) of the one or more launchers 30, wherein the output signals are processed and conveyed on a display (not shown) to show and demonstrate the relative position, velocity, and orientation of the container 20 enclosing the one or more launchers 30. The central processing unit (not shown) may also process data received from various sensors positioned within or located within the one or more launchers 30 and/or the munition receptacle 32, the sensors of which may be configured to detect a loading of the munition 70 into the munition receptacle 32 or an inserting of the munition receptacle 32 into at least one of the one or more launchers 30. The controller (not shown) may further process data received from motion-detection sensors (not shown) disposed on or about the container frame 22, the motion-detection sensors (not shown) of which may flag, signal, or indicate a physical presence or geographical proximity of a user of the mobile munition assembly 10, third-party persons, or heavy equipment or machinery, such as vehicles. The controller (not shown) may receive output signals on motion within a radius of about up to about twenty-five (25) meters from the motion-detection sensors (not shown), through the radius may be greater or lesser.

Referring to FIG. 4, an exemplary embodiment of the munition 70 is illustratively conveyed. The munition 70 may be propelled out of the munition receptacle 32 in which the munition 70 is loaded and from one of the one or more launchers 30 in which the munition receptacle 32 is inserted. The munition 70 may be propelled by an impulse or reaction. In optional embodiments, the munition 70 may be ejected by an expansion of high-pressure gases from a compressed air supply or from an ignition of a propellant charge. In other optional embodiments, the munition 70 may be launched from the one or more launchers 30 through activation and combustion of a motor (not shown) housed within a munition frame 71 of the munition 70. In further optional embodiments, the munition 70 may be an indirect-fire munition or a barrel-expelled munition. The munition 70 may be launched through activation or combustion of the motor (not shown) by a remote controller, including the controller 120 of the one or more electronic devices 110 associated with the mobile munition assembly 10 or through the controller (not shown) of the one or more launchers 30.

The munition 70 may have an exterior defined by the munition frame 71, the munition frame of which may be generally divided into at least the following sections: a nose 72, a body 74, and a tail 76. The nose 72 may be distally located from the tail 76, and the body 74 may be positioned between the nose 72 and the tail 76. The munition 70 may have a length defined from an end 73 of the nose 72 to an end 77 of the tail 76, the length ranging from about thirty-two (32) inches to about forty-eight (48) inches, though in other embodiments the length may be greater or lesser than the foregoing.

Two or more fins, such as first fins 80 and second fins 82, may be supported from and/or disposed about the munition frame 71. The two or more fins may be static or controllable. For example, the first fins 80 and/or the second fins 82 may be actuated by a motor (not shown) housed within the munition frame 71.

When not actuated, the first fins 80 and/or the second fins 82 may be operated to a launch configuration 88, wherein the first fins 80 and/or the second fins 82 are folded up adjacent to the munition frame 71; and when actuated, the first fins 80 and/or the second fins 82 may be operated to a flight configuration 89, wherein the first fins 80 and/or the second fins 82 may be pivoted away from the munition frame 71.

In optional embodiments, the first fins 80 may be static or controllable fins supported from and/or disposed about the munition frame 71 at the end 77 of the tail 76, and the first fins 80 may be articulated with respect to an axis 78 defined along the munition 70 from the end 77 to the end 73.

In other optional embodiments, the second fins 82 may be static or controllable fins supported from and/or disposed about the munition frame 71 at a location on the body 74 proximate to the tail 76, and the second fins 72 may be articulated with respect to the axis 78.

In optional embodiments, only one set of fins, either the first fins 80 or the second fins 82, may be supported from and/or disposed about the munition frame 71.

One or more wings 86 may be supported and/or disposed about from the munition frame 71 on a location on the body 74 proximate to the nose 72. The one or more wings 86 may be operable between a launch configuration 88 and a flight configuration 89, as illustratively conveyed in FIGS. 4 and 9. In the launch configuration 88, the one or more wings 86 may be folded up adjacent to the munition frame 71. In optional embodiments, the one or more wings 86 may be folded up into the munition frame 71 in the launch configuration 88 such that the one or more wings 86 are disposed within an outer bound of the munition frame 71 in the launch configuration 88. In the flight configuration 89, the two or more wings 86 may be pivoted away from the munition frame 71. Where the two or more wings 86 are operated to the flight configuration 89, the two or more wings 86 may be perpendicular to the axis 78.

One or more of the wings 86 may include a camera 85 mounted to, integrated with, or otherwise disposed on one or more of the wings 86. In optional embodiments, the camera 85 may be mounted on a distal tip of the wing 86, thereby providing a wingtip mounted camera as illustratively conveyed in FIG. 4. In optional embodiments, the camera 85 may be mounted to, integrated with, or otherwise disposed on the wing 86 at a location between the distal tip of the wing 86 and the munition frame 71. The camera 85 is mounted to, integrated with, or otherwise disposed on the wing 86 and is oriented to capture one or more successive images in the direction of the nose 72 of the munition frame 71. Accordingly, the camera 85 may be folded into the munition frame 71 when the wings 86 are provided in the launch configuration 88.

The camera 85 may be any suitable camera for executing the functions described herein. In optional embodiments, the camera 85 may be one or more of a wide-field camera, a near-field camera, video camera, or high-resolution electro-optical camera. The camera 85 may have sensitivity to visible light, infrared (IR), ultraviolet (UV), or other light frequencies. In optional embodiments, the camera 85 may sense radiation, such as visible light, infrared light, or ultraviolet light, reflected or otherwise emitted from a targetable asset 92. The camera 85 may be operatively coupled with a controller 120 of the one or more electronic devices 10 associated with the munition 70. The camera 85 may capture and transmit one or more images and/or live video feed.

A warhead 84, a guidance system 87, and a fuze (not shown) may be housed within the munition frame 71, including at a location within the munition frame 71 at the nose 72. The fuze may be initiated to cause detonation of the munition 70 upon impact, in proximity, by time delay, or remotely (such as by and through the one or more electronic devices 110).

In optional embodiments, the warhead 84 may have a length ranging from about ten (10) inches about twenty (20) inches, though the length may be greater or lesser.

In other optional embodiments, the warhead 84 may have a weight between about eight (8) pounds and fifteen (15) pounds, though the weight may be greater or lesser.

In further optional embodiments, the warhead 84 may constitute any one of the following warheads: M151, M156, M229, M247, M255, M255E1/A1, M257, M259, M261, M264, M267, M274, M278, M282, M229, WTU-1/B, WDU-4/A, or WDU-4A/A, or other warheads, including those configured to provide surface-to-air or surface-to-surface capability.

In yet further optional embodiments, the warhead 84 may comprise any warhead having a threaded interface that allows for interchangeability with the one or more launchers 30 and/or the munition receptacle 32 of the at least one mobile munition assembly 10.

Where the munition 70 is loaded into the munition receptacle 32, and is thereby inserted into the container 20, a total weight of the container 20, the munition receptacle 32, and the munition 70 (including the warhead 84 therein) may range up to about fifty (50) pounds, though in other embodiments the total weight may be greater than the foregoing.

The guidance system 87 of the munition 70 may include global positioning system (GPS) navigation or inertial guidance system (IGS) navigation. The GPS may determine a location of the munition 70 during a flight path 99 of the munition 70, the flight path 99 of which is illustratively conveyed in FIG. 12. GPS preferably comprises an antenna (not shown) and a processor (not shown), the processor of which provides position- and velocity-based data and analytics for suitable navigational coordinates. The GPS, which is associated with a data interface of a controller (not shown) for receiving from an external source, such as a satellite, location data pertaining to the mission environment 90 and one or more targetable assets 92, may calculate expected relative location data of the munition 70 with respect to the one or more targetable assets 92 within the mission environment 90.

The guidance system 87 may additionally include the camera 85. Utilizing at least one image and/or video feed captured by the camera 85, the controller 120 of the one or more electronic devices 10 associated with the munition 70 may determine a location of the munition 70 during a flight path 99 of the munition 70 relative to one or more targetable assets 92 within the mission environment 90. Within the scope of the guidance system 87, the controller 120 of the one or more electronic devices 10 associated with the munition 70 may be operatively coupled to the camera 85 and the one or more fins 80, 82 such that the controller 120 may control the fins 80, 82 in accordance with images and/or video feed captured by the camera 85.

In other embodiments of the munition 70, the IGS of the guidance system 87 may include one or more inertial measurement units (IMUs). IMUs may include a number of sensors including, but not limited to, accelerometers, which measure (among other things) velocity and acceleration, gyroscopes, which measure (among other things) angular velocity and angular acceleration, and magnetometers, which measure (among other things) strength and direction of a magnetic field. Generally, an accelerometer provides measurements, with respect to (among other things) force due to gravity, while a gyroscope provides measurements, with respect to (among other things) rigid body motion. The magnetometer provides measurements of the strength and the direction of the magnetic field, with respect to (among other things) known internal constants, or with respect to a known, accurately measured magnetic field. The magnetometer provides measurements of a magnetic field to yield information on positional, or angular, orientation of the IMU; similar to that of the magnetometer, the gyroscope yields information on a positional, or angular, orientation of the IMU. Accordingly, the magnetometer may be used in lieu of the gyroscope, or in combination with the gyroscope, and complementary to the accelerometer, in order to produce local information and coordinates on the position, motion, and orientation of the IMU. In optional embodiments, the IMUs may also include any number of a temperature sensor, a shock or impact sensor, a photodetector, an electrostatic sensor, an air pressure sensor, or a clock, timer, or sensor otherwise used to measure elapsed or absolute time. Principally, the IMU may provide kinematic- or position-based data, including position, velocity, yaw, pitch, and roll. In optional embodiments, the IMU may constitute a micro electro-mechanical system (MEMS) in which the gyroscope and the accelerometer provide accurate information on attitude, azimuth, relative position, and velocity of the munition 70 during a trajectory or an altitude 98 of a launch of the munition 70 or the flight path 99 of the munition 70 in the mission environment 90.

Within the guidance system 87 of the munition 70, a processing and control unit, such as a munition avionics processor (not shown), may be configured to process the data received from the IMU or the GPS to determine or estimate a location and orientation of the munition 70 in the mission environment 90. The processing and control unit (not shown) of the guidance system 87 may be further configured to control the erection of the two or more wings 86, the first fins 80, and/or the second fins 82, during the flight configuration 89. Such erection of the two or more wings 86 during the flight configuration 89 may be actuated by the motor (not shown) housed within the munition frame 71. In optional embodiments, the motor (not shown) may be electrically driven. The guidance system 87 may receive a requisite voltage to operate the motor (not shown) from a power source (not shown) and the processing and control unit (not shown) of the munition 70. The processing and control unit (not shown) of the munition 70 may include a communication unit (not shown), configured to provide wireless communication between the processing control unit (not shown) of the munition 70 and the controller of the one or more launchers 30 or one of the one or more electronic devices 110.

In optional embodiments, one of the one or more electronic devices 10 associated with the munition 70 may provide the functionality of the guidance system 87 as described above. The processor 113, communication unit 114, location unit 115, sensor unit 116, and controller 120 of the one or more electronic devices 10 associated with the munition 70 may determine the location of the munition 70 during a flight path 99 of the munition 70 and control the flight path 99 of the munition 70 as described above.

FIG. 5 illustrates a flowchart providing an exemplary embodiment of the method 200 of executing a mission for the at least one mobile munition assembly 10, in accordance with aspects of the present disclosure. The method 200 may commence with an operation 202 of deploying at least one mobile munition assembly 10 in the mission environment 90. The stabilizer 40 may be operated from the first configuration 42 to the second configuration 43, wherein the plurality of legs 41 are pivoted away from the container frame 22 of the container 20. The second configuration 43 may place the container 20 in the upright position, such that the axis 26 defined along the container frame 22 from the first end 23 to the second end 24 is generally orthogonal to the surface 97 of the launch terrain 96.

Alternatively, where the stabilizer 40 is operated to the second configuration 43, the container may be placed in a semi-upright position, such that the axis 26 from the first end 23 to the second end 24 may form an angle relative to the surface 97 of the launch terrain 96, ranging from between about 30 degrees to 90 degrees.

The munition 70 may be loaded into the munition receptacle 32, and the munition receptacle inserted into at least one of the one or more launchers 30 of the at least one mobile munition assembly 10. In optional embodiments, the operation 202 of deploying at least one mobile munition assembly 10 in the mission environment 90 may additionally or alternatively include transporting a number of the at least one mobile munition assemblies 10 on a cargo surface 68 of a vehicle 66 to a designated location within the mission environment 90 and unloading the at least one mobile munition assembly 10 from the vehicle 66, keeping the at least one mobile munition assembly 10 loaded onto the vehicle 66 to perform a launch directly from the vehicle 66, or a combination thereof.

The method 200 may continue with an operation 204 of communicatively coupling one or more electronic devices 110, by and through the communication unit 114, with one another in the mission environment 90, such that each of the one or more electronic devices 110 are in association with one another, and at least one of the one or more electronic devices 110 is associated with one or more of the at least one mobile munition assembly 10. The one or more electronic devices 110 may form, or establish, the secure network 102 when the one or more electronic devices 110 are communicatively coupled to, and in association with, one another, as illustratively conveyed in FIGS. 1A-1D.

In other optional embodiments, the one or more electronic devices 110 communicatively coupled to, and in association with, one another may be recruited to the secure network 102 by another of the one or more electronic devices 110 or by a remote system, such as the administrator 104.

In further optional embodiments, one or more electronic devices 110 may be communicatively connected to one another, wherein at least one of the one or more electronic devices 110 may be associated with one or more of the at least one mobile munition assembly 10.

As described previously, the secure network 102 may comprise a mobile ad-hoc network (MANET) or a wireless mesh network (WMN).

The method 200 may continue with an operation 206 of transmitting at least signals representative of a situational awareness (SA) corresponding to each of the one or more electronic devices 110, including those of the one or more electronic devices 110 associated with the at least one mobile munition assembly 10 and/or the munition 70. The signals representative of the situational awareness (SA) may be received and outputted by the location unit 115 and/or the sensor unit 116 to the controller 120, the location unit 115 and/or the sensor unit 116 of which may be couplable to the communication 114, as described above.

For the purpose of the disclosure herein, signals representative of a situational awareness (SA) may include (without limitation) position location information (PLI) and/or position vector information (PVI) of the one or more electronic devices 110, or any directional-, position-, or movement-related information pertaining to the one or more electronic devices 110 (including those associated with the at least one mobile munition assembly 10 and/or munition 70) in the mission environment 90. Situational awareness (SA) may additionally include information indicative of a class associated with at least one of the one or more electronic devices 10, including those associated with the at least one mobile munition assembly 10, the munition 70, or an aircraft 12, or a combination thereof.

Information indicative of the class associated with the above-mentioned one or more electronic devices 10, otherwise known as class information and conveyed through signals representative of a class, may include information defining a particular class of an object or the one or more electronic devices 10 according to one or more categories. The one or more categories of class information may include at least the aircraft 12, the mobile munition assembly 10, the one or more electronic devices 10 associated with a user, with an observer, and/or an administrator 104, and may further include any number of a specific subcategory of each class. Signals representative of class information may include information defining a set of physical parameters associated with each class or subcategory of each class. Class information associated with the at least one mobile munition assembly 10 and/or the munition 70 may indicate the physical limitations associated with each of the at least one mobile munition assembly 10 and/or the munition 70, including all possible trajectory information, including information indicating the specific warhead 84, maximum launch velocity, maximum launch impulse per unit of mass ($\Delta V$), munition frame physical characteristics, targetable range 91, including a maximum glide ratio, and any information characteristic of the physical limitations of the launcher 30 and munition 70 that are preexisting at the time of launch of the munition 70 from the at least one mobile munition assembly 10. Class information associated with the at least one aircraft 12 may indicate operating parameters of the aircraft 12, including maximum vertical speed, maximum attainable velocity, thrust/weight ratio, and any other information associated with the physical operating parameters of the at least one aircraft 12.

Situational awareness (SA) may also encompass environmental factors or other external conditions pertaining to, or affecting, the one or more electronic devices 110, the at least one mobile munition assembly 10, and/or the mission environment 90, including any perception or monitoring of a targetable range 91, one or more targetable assets 92, one or more non-targetable assets 94, or the munition 70 (and the altitude 98 or the flight path 99 of the munition 70).

Situational awareness (SA) may also include characteristics or features pertaining to the mission environment 90, including a type of the launch terrain 96 (e.g., mountainous, rocky, desert- or tundra-like, wooded, forested, hilled, etc.) and the surface 97 of the launch terrain 96.

Figure 10:
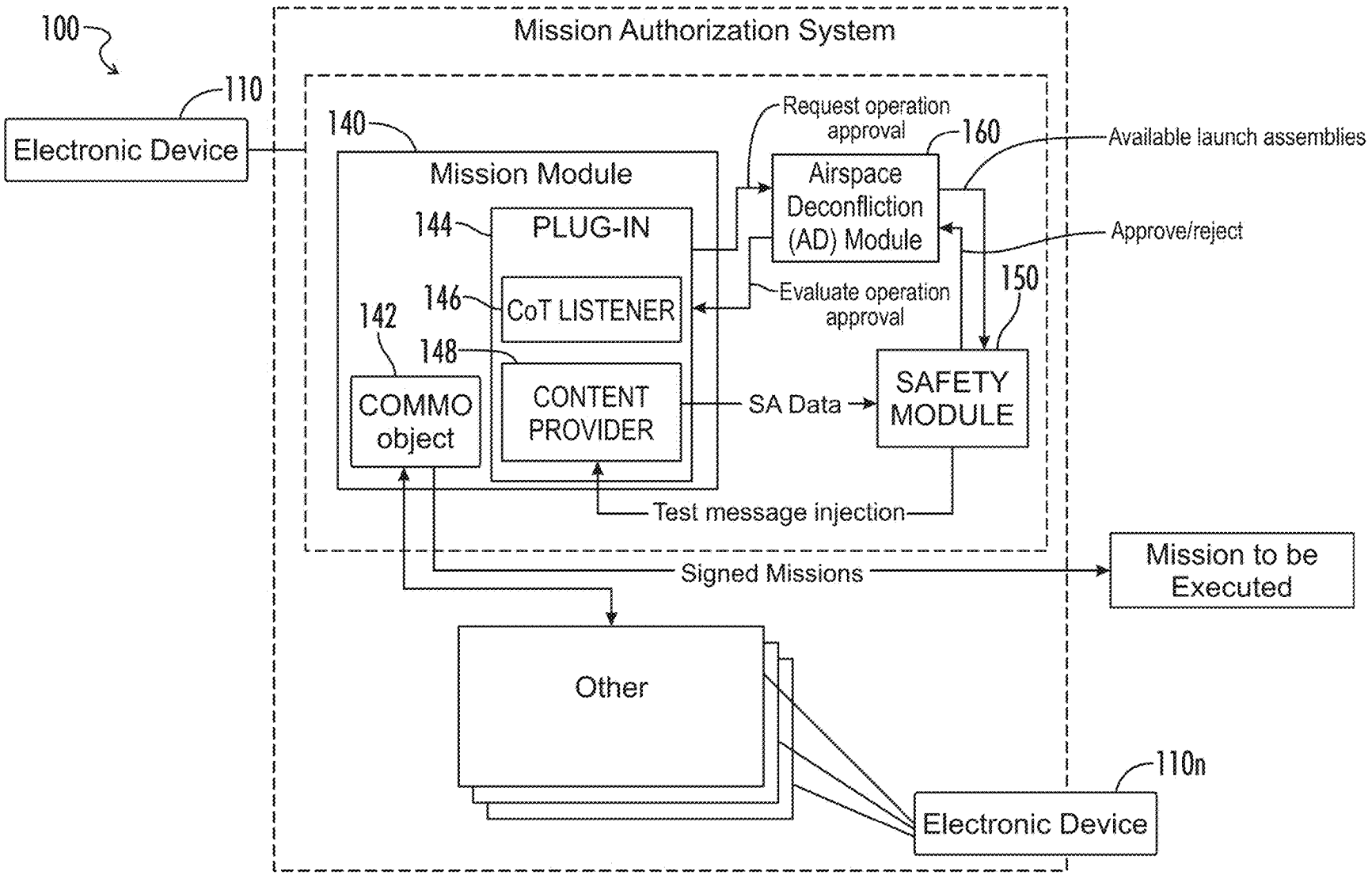
FIG. 10 illustrates another exemplary embodiment of a partial block diagram of a system for executing a mission for at least one mobile munition assembly, the system comprising one or more electronic devices having a safety module and a mission module, in accordance with aspects of the present disclosure.

As depicted in FIG. 10, the signal representative of the situational awareness (SA) may be received, on or thorough the communication 114 of the one or more electronic devices 110, by a communication (or "COMMO") object 142 provided by the mission module 140 of the mission execution unit 130, executable by the controller 120. The COMMO object 142 may use device-specific libraries residing on the one or more electronic devices 110, for the purpose of sending the information corresponding to the situational awareness (SA) of the one or more electronic devices 110 to a plug-in 144, or other software application 144, downloadable and implementable by the one or more electronic devices 110. The plug-in 44 may include a cursor-on-target (CoT) Listener 146, the CoT Listener 146 of which may be configured to filter the information corresponding to the situational awareness (SA) of the one or more electronic devices 110 (or information corresponding to the network 102), including the one or more electronic devices 110 associated with one or more of the at least one mobile munition assembly 10.

The method 200 may continue with an operation 208 of enabling an input of parameters of the mission for the at least one mobile munition assembly 10. The parameters of the mission for the at least one mobile munition assembly 10 may be inputted, manually or otherwise, on the display unit 117 on at least one of the one or more electronic devices 110 vis-à-vis a user interface on the display unit 117. Accordingly, the system 100 may initiate with the entry (and receipt) of the parameters of the mission by and through the mission module 140 of the mission approval unit 130, as depicted in FIGS. 5 and 9. The mission module 140 of the mission approval unit 130 may be executable by the controller 120 of any one of the one or more electronic devices 110. The plug-in 144, or the other software application 144, may be configured to receive the parameters of the mission for the at least one mobile munition assembly 10, whether provided by a user of the one or more electronic devices 110, provided by a centralized entity, such as the administrator 104, or provided by the airspace deconfliction (AD) module or safety module.

In optional embodiments, the plug-in 144 may further include a content provider 148, the content provider 148 of which may comprise a structured query language (SQL) database instantiated by the plug-in 144. The plug-in 144 may receive the parameters of the mission, as illustratively conveyed in FIGS. 5 and 10 by and through the display unit 117 having the user interface (UI) associated therewith, and the content provider 148 may receive, from the CoT Listener 146, filtered information corresponding to the situational awareness (SA) of the one or more electronic devices 110. Parameters of the mission may comprise any instructions, directions, or other guidance for the at least one mobile munition assembly 10 or the munition 70 launched therefrom, including an instruction to launch the munition 70 at the one or more targetable assets 92 in the mission environment 90, as illustratively conveyed in FIGS. 8-9, and additionally or alternatively including an instruction to launch the munition 70 based at least upon an airspace collision avoidance status and/or a ground proximity status.

Other parameters of the mission may include an instruction to select more than one of the at least one mobile munition assembly 10, the function of which is to launch a plurality of munitions 70 at the one or more targetable assets 92 from a plurality of the at least one mobile munition assembly 10 in the mission environment 90, including an instruction to select one or more of the at least one mobile munition assembly 10 based at least upon an airspace collision avoidance status.

Other parameters of the mission may include an instruction from the one or more electronic devices 110 including a user command with a defined authority level, including an override command to fire the munition 70 without being based at least on an airspace collision avoidance status or a ground proximity status.

One or more predefined rules 210 may be related to the parameters and may be configured to be applied to the parameters of the mission based on at least the status of the situational awareness (SA). The content provider 148 of the plug-in 144 may have stored thereon one or more predefined rules 210 related to at least the parameters of the mission. The one or more predefined rules 210 may comprise a rule set that is deterministic, presented in human-readable syntax, and/or may include static or dynamic elements pertaining to the mission.

In optional embodiments, the one or more predefined rules 210 may include at least one of information corresponding to at least to one of a location of the one or more electronic devices 110 in the mission environment 90, a location of the at least one mobile munition assembly 10 in the mission environment 90, an identification of one or more targetable assets 92 in the mission environment 90, an identification of one or more non-targetable assets 94 in the mission environment 90, the altitude 98 of the munition 70 when launched from the at least one mobile munition assembly 10, a trajectory of the munition 70 when launched from the at least one mobile munition assembly 10, the flight path 99 of the munition 70 when launched from the at least mobile munition assembly 10, a type of the warhead 84 located within the munition 70, an impact radius of the munition 70, or a time constraint on the mission.

The one or more predefined rules 210 may also include at least one of a height, roughness, or other characteristic of the surface 97 of the launch terrain 96 provided in the mission environment 90, nominal trajectory data associated with the munition 70 launched from the at least one mobile unition assembly 10, or trajectory dispersions associated with the munition 70 launched from the at least one mobile munition assembly 10, and combinations thereof.

In other embodiments, the one or more predefined rules 210 may comprise a rule set presenting criteria for which the mission for the at least one mobile munition assembly 10 is at least one of the following: safe or unsafe conditions in the mission (e.g., presence of one or more non-targetable assets 94 in the mission environment 90), too soon or too late for a duration of the mission, or too close or too far within the mission environment.

In other optional embodiments, the one or more predefined rules 210 may include criteria pertaining to a proximity to third-party entities or assets, including individuals, structures, or vehicles, all of which may be classified as the non-targetable assets 94, or areas otherwise geofenced or kept out within the mission environment 90.

In further optional embodiments, the one or more predefined rules 210 may comprise preloaded data pertaining to the mission for the at least one mobile munition assembly 10, including (without limitation): latitudes, longitudes, and altitudes with respect to a common coordinate system as it pertains to the mission environment 90; the type of munition 70 to be launched from the one or more launchers 30; a propellant charge for the munition 70, as well as the type and function of the fuze for the munition 70; or a number of munitions 70 to be launched from the one or more launchers 30, an azimuth of a launch of the munition 70, or a method of control of the munition 70 subsequent to a launch and during the flight path 99; and combinations thereof, or the like.

Other preloaded data pertaining the to the mission for the at least one mobile munition assembly 10 may include mission data exchanged across the secure network 102 among the one or more electronic devices 110 (including those associated with the at least one mobile munition assembly 10), including, but not limited to, command-to-launch messages, denial-of-mission messages, end-of-mission messages, check-fire messages, cancel-check-fire messages, and other support data exchanged across the network 102 of the one or more electronic devices 110 (including those associated with the at least one mobile munition assembly 10).

Application of the one or more predefined rules 210 to the parameters of the mission based at least on the signals representative of the situational awareness (SA) corresponding to each of the one or more electronic devices 110 may be carried out by the safety module 150 in coordination with the airspace deconfliction (AD) module 160, which is executable by the mission approval unit 130 of the controller 120. The safety module 150 and/or the airspace deconfliction (AD) module 160 may receive, from the content provider 148 of the plug-in 144, information corresponding to the situational awareness (SA) and the parameters of the mission, as well as the one or more predefined rules 210 related to at least the parameters of the mission. The application of the one or more predefined rules 210 by the safety module 150 in coordination with the airspace deconfliction (AD) module 160 may ascertain or determine whether the parameters of the mission comport with limitations or instructions provided by criteria of the one or more predefined rules 210.

The method 200 may continue with an operation 212 identifying the one or more targetable assets 92 and the one or more non-targetable assets 94 in the mission environment 90 based at least on the parameters of the mission for the at least one mobile munition assembly 10 and an application of the one or more predefined rules to the parameters of the mission.

In optional embodiments, identification of the one or more targetable assets 92 and the one or more non-targetable assets 94 in the mission environment 90 may be carried out or effectuated by geo-based position locating or by a user manually identifying one or more non-targetable assets 94 and the one or more targetable assets 92 in the mission environment 90; and, in other optional embodiments, the operation 212 of identifying the one or more targetable assets 92 within the mission environment may be carried out or effectuated by a laser-based rangefinder, such as FLIR's Recon VR rangefinder, where the lase-based rangefinder is configured to communicate with the one or more electronic devices 110 and provide position locator information to the one or more electronic devices 110 in the mission environment 90.

Figure 11:
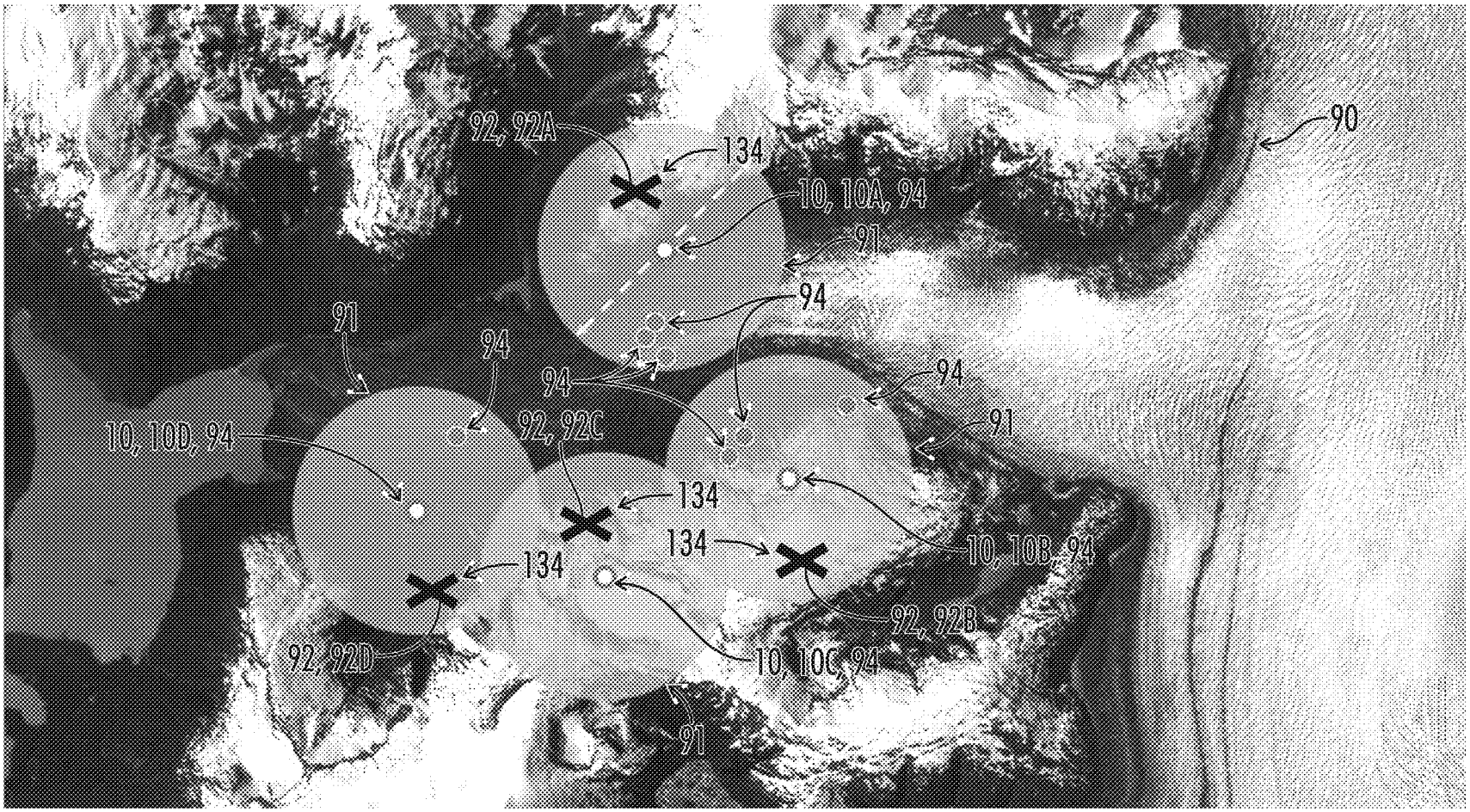
FIG. 11 illustrates an exemplary embodiment of a mission environment, wherein there are one or more targetable assets and one or more non-targetable assets identified by the system for executing a mission for at least one mobile munition assembly, in accordance with aspects of the present disclosure.

Referring to FIG. 11, the operation 212 of identifying the one or more targetable assets 92 in the mission environment 90 is illustratively depicted. The one or more targetable assets 92 may include a first targetable asset 92A, a second targetable asset 92B, a third targetable asset 92C, and a fourth targetable asset 92D. A first mobile munition assembly 10A, a second mobile munition assembly 10B, a third mobile munition assembly 10C, and a fourth mobile munition assembly 10D may be configured to identify one or more targetable assets 92 and one or more non-targetable assets 94 within a targetable range 91 corresponding to each of the at least one mobile munition assembly 10.

As depicted in FIG. 11, a first of the targetable range 91 may overlap or intersect with a second of the targetable range 91 (and so forth), given the physical proximity of the at least one mobile munition assembly 10 in the mission environment 90. The targetable range 91 may have a radius ranging from about 500 meters to about 5 kilometers, the radius measured outwardly from a position of each of the at least one mobile munition assembly 10 in the mission environment 90, or otherwise defined by the flight path 99 of the munition 70.

In optional embodiments, the one or more non-targetable assets 94 may include the least one mobile munition assembly 10 in the mission environment 90 and/or the one or more electronic devices 110. The one or more non-targetable assets 94 may also include human users, observers, heavy equipment or machinery, vehicles, or other undesirable areas or assets that are not intended to be targeted by one or more of the at least one mobile munition assembly 10.

The method 200 may also continue with an operation 214 of reporting whether there is a mission error 216 (or mission fault 216) detected by the one or more electronic devices 10 in the mission environment 90. The mission error 216 may be detected by sending, at periodic intervals, a plurality test messages, to detect whether there is an error or fault with the one or more electronic devices 110 in communicatively coupling to, and in association with, one another, or whether there is an error (or a fault) in the secure network 102. The safety module 150 of the mission approval unit 130, executing independently of the mission module 140 of the mission approval unit 130, allows for a detection of the mission error 216 with the one or more electronic devices 110 (including the one or more electronic devices 110 associated with at least one mobile munition assembly 10) and/or the secure network 102, as conveyed in FIG. 10. By sending, or injecting, the plurality test messages, at periodic intervals, the safety module 150 may determine the mission error 216 in any component of the mission module 140, including the communications and/or data exchanges among COMMO object 142, the plug-in 144, the CoT Listener 146, or the content provider 148, or the safety module 150 may determine other errors or faults with the one or more electronic devices 110, the at least one mobile munition assembly 10, and/or (in some embodiments) the munition 70. The plurality of test messages—otherwise referred to as cursor-on-target (CoT) schema—may be generated by the safety module 50 and transmitted to the CoT Listener 146 of the plug-in 144. The plug-in 144 may record the plurality of the test messages in the content provider 148, which is thereby read by the safety module 150. To the extent the mission error 216 is detected, such data is validated or ignored, for the purpose of otherwise reliably executing the mission for the at least one mobile munition assembly 10. To execute the mission for the at least one mobile munition assembly 10, a detection of the mission error 216 may require a consensus among the safety module 150 of each of the one or more electronic devices 110 in the secure network 102, wherein a consensus mechanism may be employed to evaluate each safety module 150 against other of the safety module 150, for the purpose of shifting decision-making to the most reliable safety module 150 among the one or more electronic devices 110.

In optional embodiments, the mission error 216 detected by the one or more electronic devices 110 may include at least one of a loss of communication, on the secure network 102, of the one or more electronic devices 110 in the mission environment 90, an uncertainty of a location of the one or more electronic devices 110 in the mission environment, an uncertainty of a location of the at least one mobile munition assembly 10 in the mission environment, a latency in the secure network 102, an identification of one or more unauthorized devices on the secure network 102, an alert that the munition 70 is not configured to be launched from one of the one or more launchers 30 in the mobile munition assembly 10, an alert that at least one of the one or more launchers 30 does not have sufficient power to enable a launch of the munition 70 in the mission environment 90, an alert that the warhead 84 located with the munition 70 does not conform with the parameters of the mission, or an alert that at least one of the one or more launchers 30 is not arranged in an orientation to enable a vertical launch of the munition 70 from the surface 97 of the launch terrain 96.

In other optional embodiments, the mission error 216 detected by the one or more electronic devices 110 may include at least one of: an alert that the munition receptacle 32 is not properly or sufficiently inserted into the at least one of the one or more launchers 30; and an alert that the munition 70 is not properly loaded into the munition receptacle 32 inserted into the at least one of the one or more launchers 30.

In further optional embodiments, the mission error 216 may include at least one of invalid or incorrectly formatted data in at least one of the one or more electronic devices 110, a loss of data, such as data on the content provider 148 of at least one of the one or more electronic devices 110, missing (or absent) entries of parameters or the one or more predefined rules 210 in the content provider 148 indicating a loss of signal among the one or more electronic devices 110 or the network 102, out-of-sequence entries of parameters in the content provider 148 indicating clock- or time-related errors, missing (or absent) or misconfigured test messages injected into the mission module 140, or an overflow of at least one or more electronic devices 110 or the network 102 caused by, for example, a denial-of-service or distributed denial-of-service, out-of-sequence entries, or simultaneous updating of more than one of the one or more electronic devices 110, such as updating the mission module 140 or another routine software component residing on the one or more electronic devices 110.

Where the plurality of test messages have been sent (or injected), at periodic intervals, from the safety module 150 to the mission module 140 of the mission approval unit 130, such that the mission error 216 is detected or not detected (and otherwise ignored or acknowledged), the method may 200 may continue with an operation 218 of requesting an authorization or a denial of the mission for the at least one mobile munition assembly 10. Such a request of the authorization or the denial of the mission for the at least one mobile munition assembly 10 may be communicated from the plug-in 144 of the mission module 140 to the safety module 150, wherein the safety module 150, through the airspace deconfliction (AD) module 160, evaluates whether to accept or to reject the request for the authorization of the mission for the at least one mobile munition assembly 10. Evaluation may be effectuated through an evaluation, by the safety module 150 and through the airspace deconfliction (AD) module 160, of the application of the one or more predefined rules 210 to the parameters of the mission, including two-dimensional or three-dimensional assessments of the one or more targetable assets 92, the one or more non-targetable assets 94, locations of the one or more electronic devices 110 and the at least one mobile munition assembly 10, and/or the mission environment 90. Application of the one or more predefined rules 210 may be based on at least the status of the situational awareness (SA) corresponding to the one or more electronic devices 110, as previously set forth herein. Application of the one or more predefined rules 210 may be additionally based on at least an airspace collision avoidance status as set forth below.

Evaluation effectuated through an evaluation, by the safety module 150 and through the airspace deconfliction (AD) module 160, of the application of the one or more predefined rules 210 to the parameters of the mission may be further implemented based on an available launcher status provided from the airspace deconfliction (AD) module 160 to the safety module 150. The airspace deconfliction (AD) module 160 may be executable by the mission approval unit 130 of the controller 120. The airspace deconfliction (AD) module 160 may run simultaneously in the plug-in 144 and the safety module 150.

In optional embodiments, the airspace deconfliction (AD) module 160 may be a standalone module that receives information from and transmits information to both the plug-in 144 and the safety module 150.

In other embodiments, the airspace deconfliction (AD) module 160 may be integrated with the safety module 150 or the plug-in 144.

The airspace deconfliction (AD) module 160 may be configured to provide, to the safety module 150, one or more of the at least one mobile munition assembly 10 available for launch based at least upon an airspace collision avoidance status.

In optional embodiments, the airspace deconfliction (AD) module 160 may operate according to the data flow operation 300 as described below to create launcher object, aircraft objects, and detect interactions between the future position areas of the aircraft and launcher objects ($FPA_A$) and ($FPA_L$), respectively.

Evaluation effectuated through an evaluation, by the safety module 150 and through the airspace deconfliction (AD) module 160, of the application of the one or more predefined rules 210 to the parameters of the mission may additionally include a determination of an airspace deconfliction status as described herein. The airspace collision avoidance status may be dynamically determinable by the airspace deconfliction (AD) module 160 over a maximum future time of consideration of launch, otherwise known as the maximum future time of launch consideration ($t_{max}$), of the munition 70. The determination of the airspace collision avoidance status my include consideration of a number of signals associated with a number of objects, including the one or more electronic devices 110, the at least one mobile munition assembly 10, the at least one munition 70, and/or the at least one aircraft 12. The consideration of a number of signals may include consideration of signals representative of the situation awareness (SA) of each or more the above mentioned objects, signals representative of a class of each of the above mentioned objects, and/or a time window representing the maximum future time of launch consideration ($t_{max}$) of the munition 70.

Figure 6:
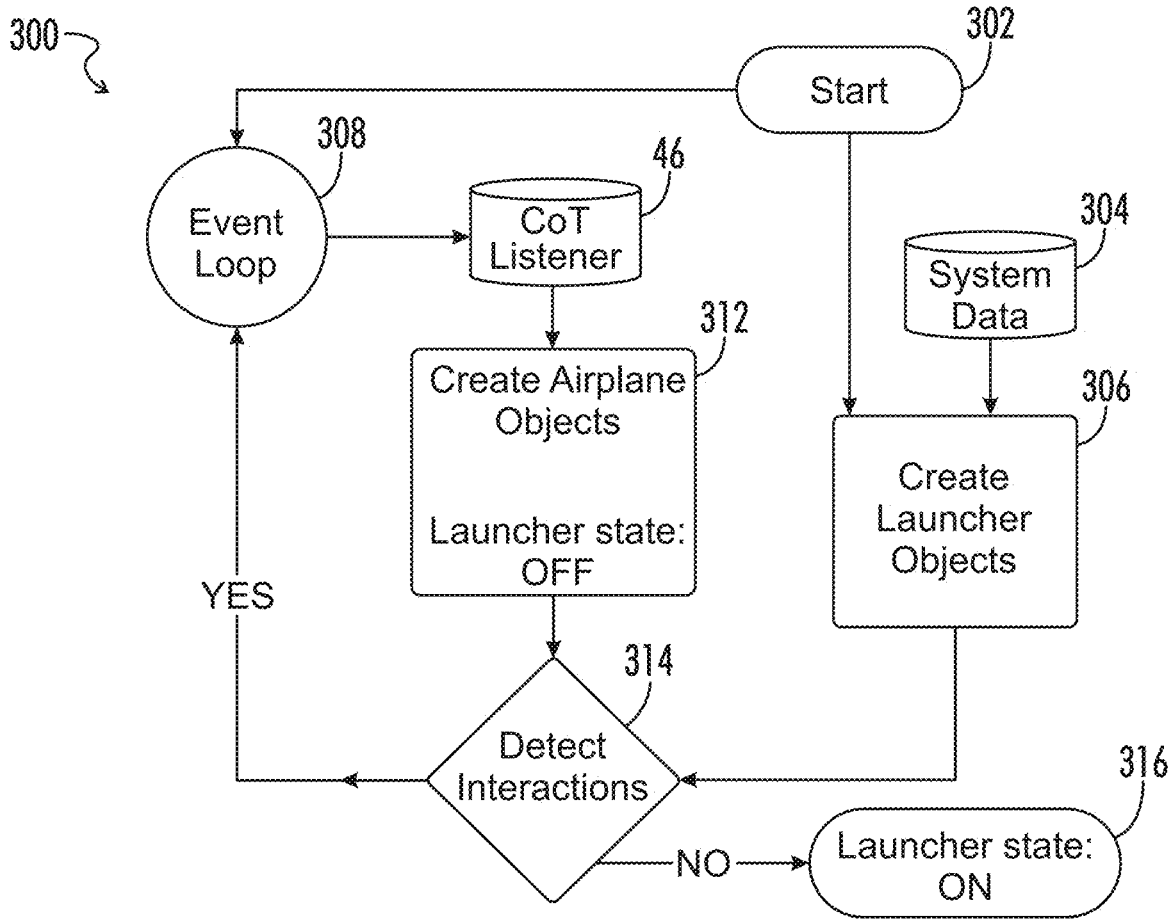
FIG. 6 illustrates a flowchart providing an exemplary embodiment of a method for determining an airspace collision avoidance status, in accordance with aspects of the present disclosure.

In optional embodiments, the determination of the airspace collision avoidance status may incorporate an exemplary data flow operation 300 as illustrated in FIG. 6. The data flow operation 300 may operate in an on/off result configuration, designating the launch of a munition 70 only when the launch state toggles to an ON state 316. Otherwise, if the data flow operation 300 cannot determine a valid airspace collision avoidance status, the data flow operation 300 remains in an OFF state and does not provide authorization to launch the munition 70. In an exemplary embodiment of the data flow operation 300, upon start 302 of the data flow operation, the airspace deconfliction (AD) module 160 provides for the creation of launcher objects 306 via system data 304. This system data may include signals representative of the situational awareness (SA) and/or class information of the at least one mobile munition assembly 10, including position location information (PLI), namely geocoordinate latitude, longitude, and altitude.

The data flow operation 300 may further operate to initiate an event loop 308. The event loop 308 may further operate to accept information associated with all of the at least one aircrafts 12 within 1° of the one or more electronic devices 10, including the CoT Listener device 146 that is included within the one or more electronic devices 10 of one or more of the at least one mobile munition assembly 10, the munition 70, a user, and/or an observer.

The data flow operation 300 may continue to create aircraft objects 312, with each aircraft object associated with signals representative of situational awareness (SA) of each aircraft 12, including position location information (PLI), position vector information (PVI), and/or aircraft class information. In exemplary embodiments, the CoT Listener device 146 will create an aircraft object 312 with position information, including geocoordinate latitude, longitude, altitude, and speed.

The data flow operation 300 may continue with a process of detecting possible interactions 314 between the aircraft objects and the launcher objects. The process of detecting interactions 314 operates to detect possible points of intersection 418 between an aircraft future position area ($FPA_A$) 410 and a launcher object future position area ($FPA_L$) 402. For purposes of the present disclosure, reference to the launcher object future position area refers to a future position area determinable for any number of the at least one mobile munition assembly 10 and/or the munition 70. The process of determining future position areas (FPAs) of both the aircraft and the launch object will be described in greater detail herein.

The data flow operation 300 may continue with repeating the event loop 308 in the event that any potential interactions are detected between the aircraft future position area ($FPA_A$) 410 and the launcher object future position area ($FPA_L$) 402, in which case, the launcher state will remain in an OFF position. The event loop for detecting interactions between the aircraft future position area ($FPA_A$) 410 and the launcher object future position area ($FPA_L$) may repeat once every second or may be manually configured to repeat at any desired time interval. Alternatively, the data flow operation 300 may continue with authorizing the at least one mobile munition assembly 10 for launch based on at least the lack of any interaction between the aircraft future position area ($FPA_A$) 410 and the launcher object future position area ($FPA_L$), in which case, the launcher state will toggle to an ON position 316.

For purposes of the present disclosure, reference to any aircraft or launcher object future position area refers to a volume of space that may be presently or in the future physically occupied by the at least one mobile munition assembly 10, the munition 70, and/or the aircraft 12, and is further used to detect whether an intersection may occur among any two or more of the determinable future position areas (FPAs).

In optional embodiments, the future time used for determination of a future position area (FPA) may be established as a maximum future time for consideration ($t_{max}$) of the launch of the munition 70.

Figure 7:
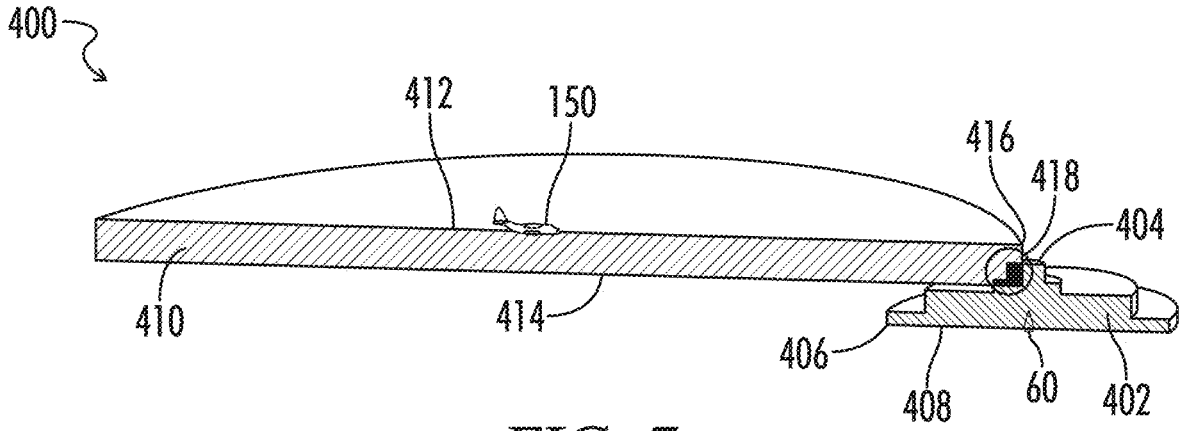
FIG. 7 illustrates an exemplary embodiment of a process for detecting interactions between an air vehicle and a portable launch assembly, in accordance with aspects of the present disclosure.

As illustratively conveyed in FIGS. 6-8, future position areas (FPAs) 400 may represent time-dependent hazard areas, representing the physical limits of where the munition 70 and/or the aircraft 12 may be physically located for a given maximum future time for consideration ($t_{max}$). The future position areas (FPAs) are determinable to account for all potential positions of the munition 70 and/or the aircraft 12 according to the physical limitations attributable to each of the munition and/or aircraft. Accordingly, future position areas (FPAs) include determination of position uncertainties and latencies associated with the munition 70 and/or the aircraft 12 such that the size of the future position areas (FPAs) are expanded to account for possible errors in a reported position and time since the position was last updated. Further, the future position areas (FPAs) 400 may be approximated as cylindrical volumes defined generally by a radius, a floor, and a ceiling—respectively, the distance from a surface of the earth ellipsoid 408 to the bottom or the top of the future position area (FPA) cylinder.

The future position area of the munition ($FPA_L$) 402 may be determinable according to all plurality of potential munition flight paths 420 of the munition 70, as illustratively conveyed in FIG. 8. In an illustrative embodiment with specific reference to FIG. 8, the munition (not shown) may be disposed at an origin of a cartesian coordinate system, with the X-axis of the coordinate system corresponding to a horizontal distance capable of being traveled by the munition 70 and the Y-axis of the coordinate system corresponding to a vertical distance capable of being traveled by the munition 70. In the illustrative embodiment of the future position area of the munition ($FPA_L$) 402 in FIG. 8 the maximum future time for consideration ($t_{max}$) may be a future time of consideration in which a future position area (FPA) may be occupied by the munition 70—$t_{max}$ being 20 seconds in one example. The future position area of the munition ($FPA_L$) 402 may be further determinable according to class information of the at least one mobile munition assembly 10 and/or munition 70. In an exemplary embodiment, the class information of the at least one mobile munition assembly 10 and/or munition 70 may include a maximum delta-v (ΔV) and a maximum flight path. A maximum delta-v (ΔV) may be a measure of the impulse per unit of munition 70 mass that is needed to perform a maneuver such as launching from a ground surface at a known geocoordinate position. A maximum flight path may be associated with an optimal glide ratio of a given munition 70.

The future position area of the munition ($FPA_L$) 402 may be further determinable by superimposing a plurality of potential munition flight paths 420. The plurality of potential munition flight paths 420 may be determinable based on consideration of at least one potential malfunction status associated with the launch of the munition 70. In an exemplary embodiment, the malfunction status associated with the launch of the munition 70 may include a failure of the guidance system, a failure of a wing or fin deployment, a failure of a launch, or any condition which may prevent the munition 70 from attaining a maximum flight path or an optimal glide ratio. Consideration of at least one potential malfunction status associated with the launch of the munition 70 may be represented by one or more of the plurality of potential munition flight paths 420 which either do not reach a maximum altitude or a maximum downrange distance. The plurality of potential munition flight paths 420 may have a number of different maximum launch altitudes (or ceilings) (404*a-d*) and a number of different downrange distances (or radii) (406*a-d*) representing the plurality of possible flight paths based upon consideration of the at least one potential malfunction status associated with the launch of the munition 70. Where the at least one mobile munition assembly 10 is located on a ground surface 408, the floor of the future position area of the munition ($FPA_L$) 402 may be the ground surface. Accordingly, the plurality of potential munition flight paths 420 may be superimposed to determine the future position area of the munition ($FPA_L$) 402.

The future position area of the aircraft ($FPA_A$) 410 may be determinable according to all potential airspace maneuvers a given aircraft 12 may perform. The future position area of the aircraft ($FPA_A$) 410 as represented by a cylindrical volume as illustratively conveyed in FIG. 6 may be defined by a $FPA_A$ ceiling 412, a $FPA_A$ floor 414, and a $FPA_A$ radius 416. The future position area of the aircraft ($FPA_A$) 410 may therefore be evaluated for two-dimensional maneuvers of the aircraft 12 in addition to altitude changes. For any particular maximum future time for consideration ($t_{max}$), it may be possible for the aircraft 12 to occupy any two-dimensional location with a radius of the current position of the aircraft 12 as defined by the potential speed of the aircraft. The future position area of the aircraft ($FPA_A$) 410 may be further determinable according to class information of the aircraft 12. Class information of the aircraft 12 may include a maximum velocity ($V_{max}$) of the aircraft 12 and/or a thrust/weight ratio of the aircraft.

The maximum velocity ($V_{max}$) attainable by the aircraft 12 may be determinable based upon a zoom dive maneuver of the aircraft. In an exemplary embodiment, the maximum velocity ($V_{max}$) attainable by the aircraft 12, neglecting drag, may be determinable according to the aircraft's potential and kinetic energy according to the following specific energy equation:

$$\mathcal{E}^1 = h + \frac{V^2}{2g} \qquad \text{Equation 1.1}$$

The determination of the aircraft's 150 maximum velocity ($V_{max}$) via a zoom dive maneuver assumes a dragless zoom dive (a perfect transfer from potential to kinetic energy). Some aircrafts may have sufficient thrust/weight ratios to also accelerate significantly at constant altitude. The specific energy equation provided may be solved for the final velocity of the zoom dive as a function of last reported velocity, the future time for consideration ($t_{max}$), and sink rate for a constant descent velocity. In some embodiments, the last reported velocity may not be provided as a velocity parameter but may instead be determinable according to a last reported position of the aircraft, where the last reported position of the aircraft is subject to processing and/or filtering with a smoothing algorithm as known to those of skill in the art. Thus, signals representative of the last reported velocity ($V_{last}$) may be provided as signals of the last reported velocity of the aircraft, or may be determinable according to at least the last reported position of the aircraft, or some combination of both. This equation is as follows:

$$V_{max}=\sqrt{V_{last}^2-2g\dot{h}t_{max}+\dot{h}^2} \qquad \text{Equation 1.2}$$

The average velocity of the aircraft over the time $t_{max}$ can be calculated as well in the following equation:

$$V_{mean} = \frac{1}{t_{max}}\left[\frac{V_{last}^2 t_{max} - \frac{3}{2}g\dot{h}t_{max}^2}{\sqrt{V_{last}^2 - 2g\dot{h}t_{max}}}\right] \qquad \text{Equation 1.3}$$

In an illustrative example of the determination of the future position area of the aircraft ($FPA_A$) 410, as shown in FIG. 7, the aircraft 12 may be located at a coordinate position (X, Y, Z) (0, 0, 0) at time t=0. Where the maximum future time for consideration ($t_{max}$) is greater than 30 seconds, then the aircraft 12 will be capable of traveling for the maximum future time for consideration ($t_{max}$) at the maximum velocity attainable ($V_{max}$), in a straight line without altitude change to ($X+V_{max}*t_{max}$, Y), a straight zoom dive or zoom climb maneuver, or any combination thereof or variation therebetween.

The future position area of the aircraft ($FPA_A$) 410 may also be based on a temporal uncertainty of the aircraft 12. For instance, an aircraft 12 may include a transponder (not shown) configured to report the position and speed of the aircraft once every 1 to 10 seconds. Thus, a determination of the future position area of the aircraft ($FPA_A$) 410 at time (t) may account for the passage of time (t+s) since the position and speed of an aircraft 12 was last reported in determining the future position area of the aircraft ($FPA_A$). Accordingly, a determination of the aircraft future position area ($FPA_A$) radius 416 may include the sum of the following: (1) $V_{mean}*t_{max}$; (2) $V_{last}$*(device time–time of last reported position); and (3) aircraft positional uncertainty or expected error, which includes temporal uncertainty in the launch time.

The method 200 may continue with an operation 220 of receiving the authorization of the mission for the at least one mobile munition assembly 10 in the mission environment 90. The plug-in 144 of the mission module 140 may receive the authorization from the safety module 150; but, to the extent the denial of the mission for the at least one mobile munition assembly 10 is received, the method 200 may return to the operation 218 of requesting the authorization of the mission for the at least one mobile munition assembly 10 until the mission is authorized to be executed in the mission environment 90.

To the extent the authorization of the mission for the at least one mobile munition assembly 10 is accepted, the mission may be signed, or otherwise authenticated, such as through public/private two-path authentication exchanged among the one or more electronic devices 110. Each such signature or authentication of the mission for the at least one mobile munition assembly 10 may be unique to each of the one or more electronic devices 110.

Referring to FIG. 5, the method 200 may proceed with an operation 222 of selecting one or more of the at least one mobile munition assembly 10 to launch the munition 70 from the one or more of the at least one mobile munition assembly 10 in the mission environment 90. The mission module 140 of the mission execution unit 130 of each of the one or more electronic devices 110 may select, whether by user input or through autonomous selection of the at least one mobile munition assembly 10, which of the at least one mobile munition assembly 10 should be selected to launch the munition 70 in the mission environment 90. Such selection may be based upon, among other things, geographical proximity or physical proximity of the at least one mobile munition assembly 10 to the one or more targetable assets 92, the one or more non-targetable assets 94, the altitude 98 of the launch of the munition 70, a distance of the flight path 99 of the munition 70, or other characteristics pertaining to the mission environment 90, as previously discussed.

Referring to FIG. 5, the method 200 may proceed with an operation 224 of commanding the one or more of the at least one mobile munition assembly 10 to launch the munition 70 from the one or more of the at least one mobile munition assembly 10 in the mission environment 90. The operation 224 of commanding the one or more of the at least one mobile munition assembly 10, having been selected in accordance with the operation 222, may be remotely effectuated by the one or more electronic devices 110, or by a one of the one or more electronic devices 110 associated with the at least one mobile munition assembly 10. Such command may be made by a transceiver, or two-way radio, residing with the communication unit 114 of the one or more electronic devices 110, and sent to another transceiver, or other two-way radio, of the one or more launchers 30, so as to initiate a launch of the munition 70 from the at least one mobile munition assembly 10.

Figure 12:
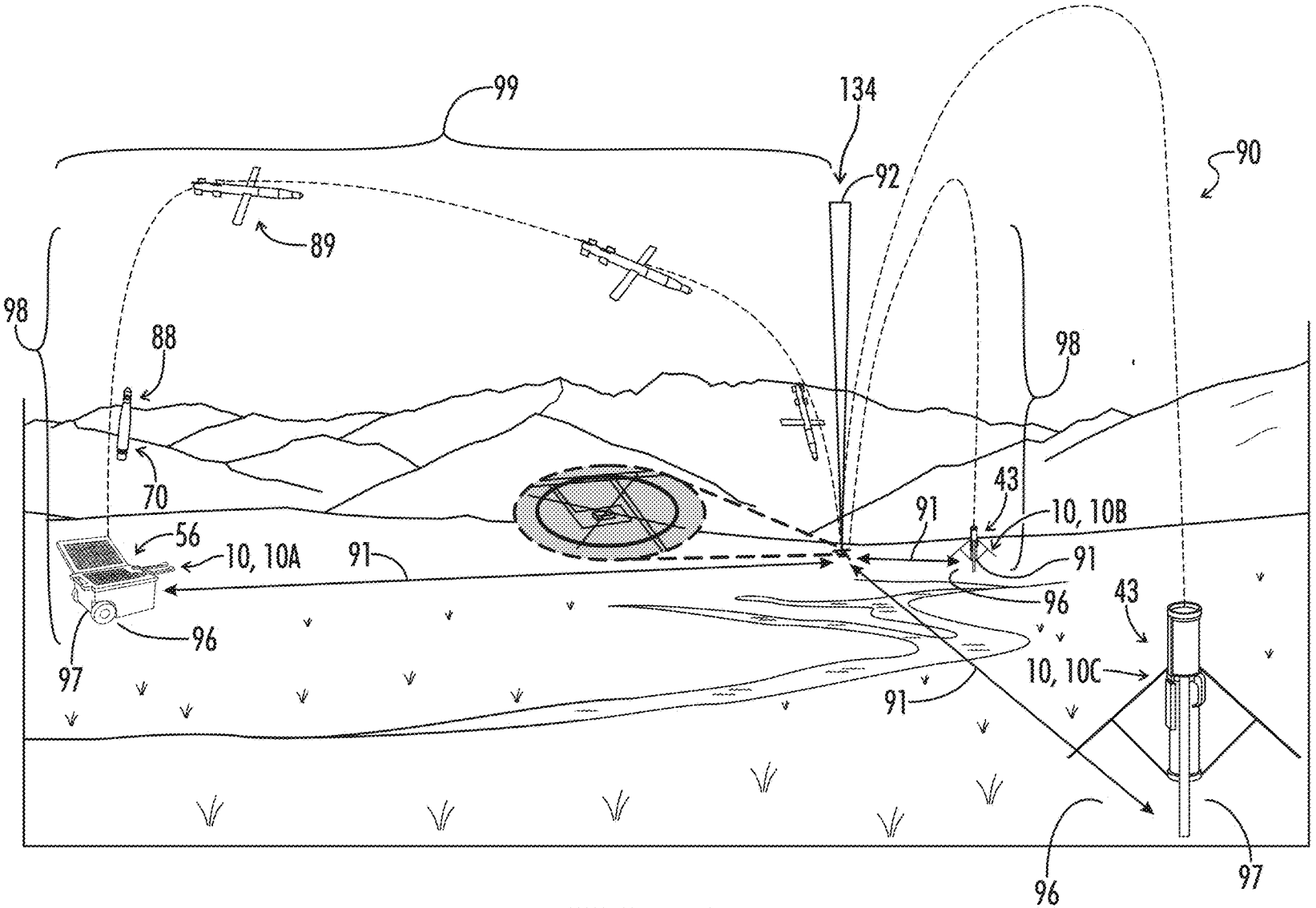
FIG. 12 illustrates an exemplary embodiment of a mission environment, wherein there are more than one of at least one mobile munition assembly, and a targetable asset has been identified by the system for executing a mission for that at least one mobile munition assembly, in accordance with aspects of the present disclosure.

Referring to FIGS. 5 and 12, the method 200 may continue with an operation 226 of launching the munition 70 from the at least one mobile munition assembly 10. The munition 70 may be configured to strike one or more targetable assets 92 in the mission environment 90 within a targetable range 91 of one or more of the at least one mobile munition assembly 10, such as the first mobile munition assembly 10A, the second mobile munition assembly 10B, and/or the third mobile munition assembly 10C. The operation 226 of launching the munition 70 may vertically launch the munition 70, in its launch configuration 88, to the altitude 98 (or the height 98) from the surface 97 of the launch terrain 96 in the mission environment, including a height of up to about eight (8) kilometers.

In optional embodiments of the method 200, the method 200 may continue with a step 228 of guiding the munition 70 in the flight path, in its flight configuration 89, to one of the one or more targetable assets 92 within the mission environment 90.

In optional embodiments, the flight path 99 may achieve a horizontal distance beginning from the launch terrain 96 to the one or more targetable assets 92 in the mission environment 90, the horizontal distance ranging up to about 100 kilometers.

In optional embodiments, the step 228 of guiding the munition 70 in the flight path 99 may be effectuated by global positioning system (GPS) navigation or inertial guidance system (IGS) navigation, and combinations thereof, or alternatively by inertial guidance system (IGS) navigation where global positioning system is denied by obstruction with the external source, such as the satellite.

In optional embodiments, the step 228 of guiding the munition 70 the flight path may be effectuated by global positioning system (GPS) navigation, inertial guidance system (IGS) navigation, the camera 85 mounted to, integrated with, or otherwise disposed on the at least one wing 86, or combinations thereof. An exemplary embodiment of the step 228 of guiding the munition 70 in the flight path as effectuation by the camera 85 mounted to, integrated with, or otherwise disposed on the at least one wing 86 is illustratively conveyed in FIG. 14.

In the step 228 of guiding the munition, the munition may operate according to an exemplary guiding method 600 and be provided with a first set of firing conditions 602. The first set of firing conditions may include one or more acquired images of the target area 134 within the targetable range 91. The acquired image of the one or more targetable asset 92, otherwise referred to as the target area, may be provided to the munition by one or more of the electronic devices 110 and may include geocoordinate location provided by GPS, satellite imagery, drone image feed, air vehicle image feed, unmanned aerial vehicle (UAV) feed, a designator, a general electronic communication device, or any other source capable of providing an image of the target area 134.

In optional embodiments, the acquired image may correspond to the first set of firing conditions and may be included in the first set of firing conditions.

The controller 120 of the one or more electronic devices 110 may recognize the acquired image of the target area 134.

After launch of the munition 70, the step 228 of guiding the munition to the target area may continue with capturing, at the munition 70, at least one image of the target area to provide at least one captured image 604.

After capturing at least one image of the target area, the step 228 of guiding the munition to the target area may continue with comparing the at least one captured image of the target area to the acquired image of the target area 606. Based on the comparison of the at least one captured image of the target area to the acquired image of the target area, the controller 20 of the electronic device 10 associated with the munition 70 may be further configured to establish a trajectory or flight path of the munition 70 from the current position of the munition to the target area. Based on the comparison of the at least one captured image of the target area to the acquired image of the target area, the controller 20 of the electronic device 10 associated with the munition 70 may be further configured to move the at least one deployable and maneuverable fin 80, 82 to perform the operation of guiding the munition to the target area 608.

Referring to FIGS. 5 and 9, the method 200 may continue with an operation 230 of impacting the munition 70 against or on one of the one or more targetable assets 92 in the mission environment 90, or the method 200 may continue with an operation 232 of disabling the flight path 99 of the munition 70 in the mission environment 90 such that the munition 70 does not make impact with or against the one of the one or more targetable assets 92 in the mission environment 90.

Figure 13:
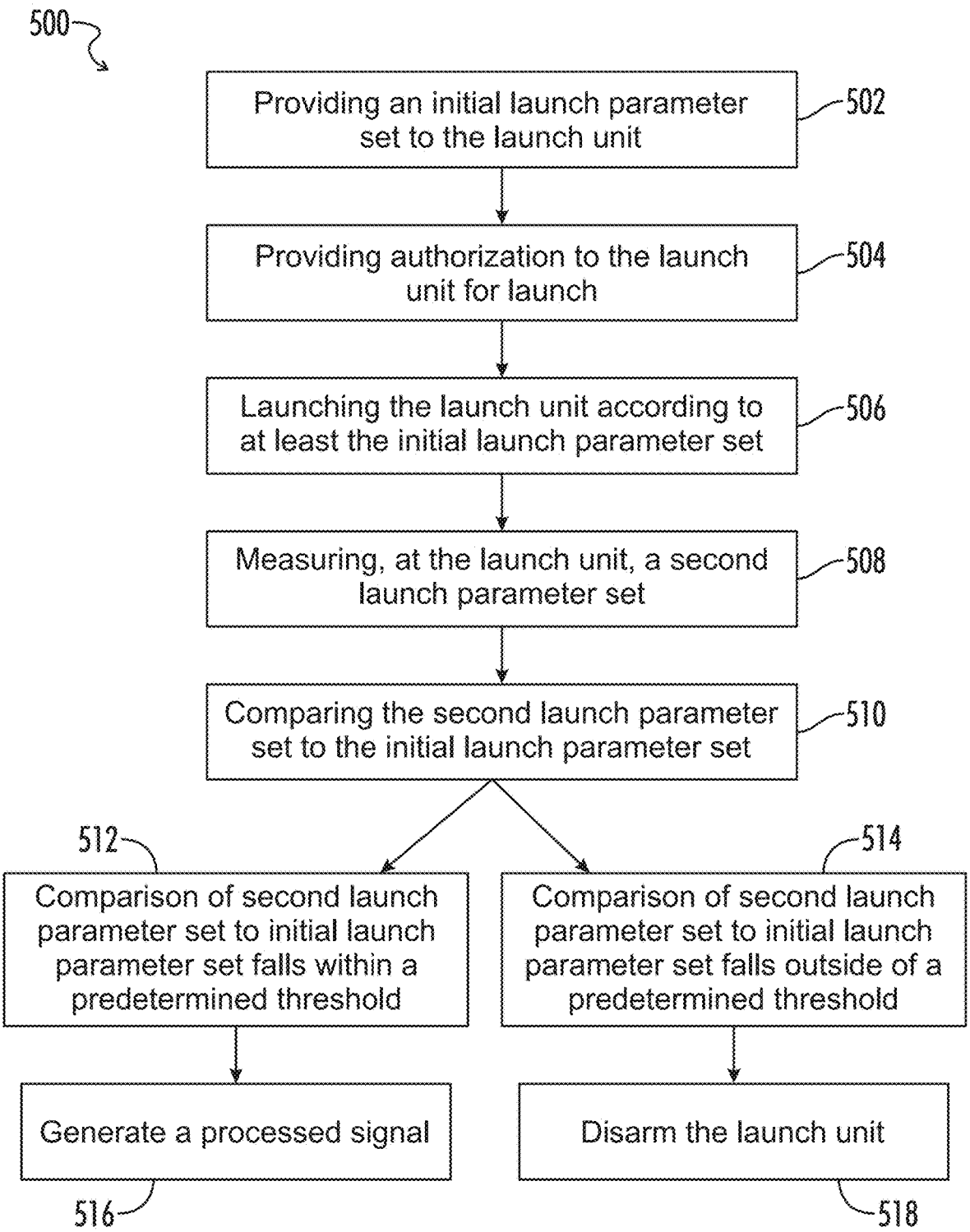
FIG. 13 illustrates a flowchart providing an exemplary embodiment of confirming an intended firing status of the launch unit, in accordance with aspects of the present disclosure.
Figure 14:
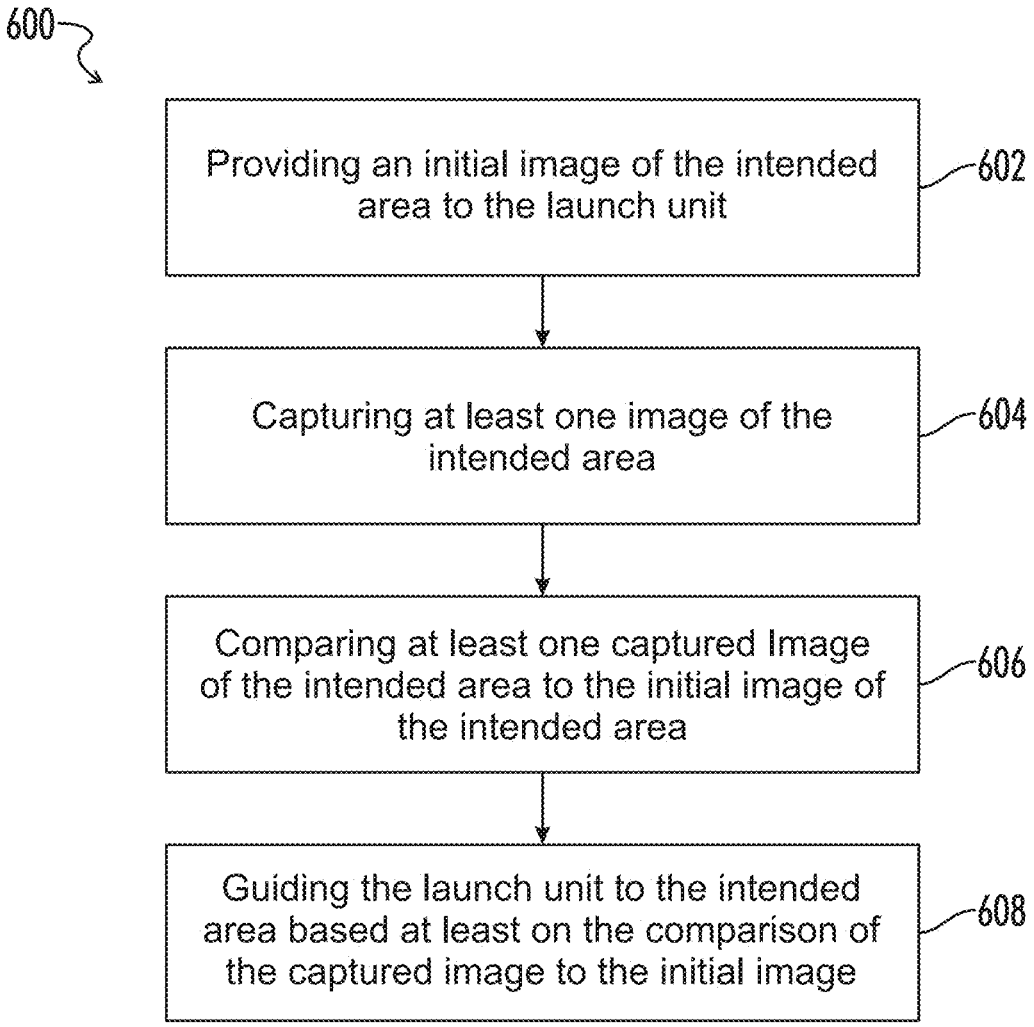
FIG. 14 illustrates a flowchart providing an exemplary embodiment of guiding a launch unit to an intended area, in accordance with aspects of the present disclosure.

In optional embodiments as illustratively conveyed in FIG. 13, the munition 70 and one or more electronic devices 10 associated with the munition 70 may perform a method 500 confirm an intended firing status of the munition 70. The term "intended firing status" as used herein provides for a confirmation that the munition 70 has launched according to a first set of firing conditions provided to the munition 70 before launch. The first set of firing conditions may include parameters of the operation for the at least one mobile munition assembly as described herein, including information corresponding to the target area for launch as located within the targetable range. By way of example, the first set of firing conditions may include any instructions, directions, or other guidance for the at least one mobile munition assembly 10, including an instruction to deliver, send, or project the munition 70 to, on, or against the target area 134 in the targetable range 91, as illustratively conveyed in FIG. 11.

Other parameters of the operation may include an instruction to select more than one of the at least one mobile munition assembly 10, the function of which is to deliver, send, or project a plurality of munitions 70 to, on, or against the at least one target asset 92 from a plurality of the at least one mobile munition assembly 10 in the targetable range 91.

Other parameters of the operation may include an instruction to launch the munition 70 from the at least one mobile munition assembly 10 based at least upon an airspace collision avoidance status. The first set of firing conditions may also include predefined threshold associated with a number of sensors, including, but not limited to, accelerometers, which measure (among other things) velocity and acceleration, gyroscopes, which measure (among other things) angular velocity and angular acceleration, magnetometers, which measure (among other things) strength and direction of a magnetic field, and any or more of a temperature sensor, a shock or impact sensor, a photodetector, an electrostatic sensor, an air pressure sensor, or a clock, timer, or sensor otherwise used to measure elapsed or absolute time.

The method 500 of confirming the intended firing status of the munition may include providing, in the munition 70, the first set of firing conditions before launch 502. Within the scope of the method 200, the step of providing the first set of firing conditions before launch 502 may be included within the operation 208 of enabling an input of parameters of a mission. Similarly, the operation of providing authorization to the munition for launch 504 may be included within the operation 220 of receiving the authorization of the mission. The method 500 of confirming the intended firing status of the munition may continue with the operation of launching the munition according to at least the first set of firing conditions 506. Within the scope of the method 200, the operation of launching the munition according to at least the first set of firing conditions 506 may be included within the step 226 of launching the munition. The method 500 of confirming the intended firing status of the munition may continue with, at the munition 70, sensing and measuring a second set of firing conditions 508. The second set of firing conditions may be sensed and measured by an initiator (not shown) present in the munition 70. The second set of firing conditions may correspond to information associated with the first set of firing conditions and may provide for a deviation from the first set of firing conditions by a predetermined threshold. The second set of firing conditions may include information measured by the munition 70 after launch.

In optional embodiments, the second set of firing conditions may include a sequence of information measured by the munition 70 after launch. By way of example, the first set of firing conditions may include one or more of an acceleration, velocity, angular acceleration, angular velocity, shock or impact, air pressure, heat, light, static electricity, spin, or time elapsed since launch. The second set of firing conditions may include information corresponding to one or more of an acceleration, velocity, angular acceleration, angular velocity, shock or impact, air pressure, or time as associated with the launch of the munition 70.

The method 500 may continue with, at the munition 70, comparing the second set of firing conditions to the first set of firing conditions 510. In optional embodiments, the step of confirming the intended firing status of the munition 70 may continue with generating a processed signal 516 via the controller 120 of the electronic device 110 associated with the munition 70. The processed signal may be associated with the comparison of the second set of firing conditions to the first set of firing conditions such that the processed signal is generated only when the comparison of the second set of firing conditions to the first set of firing conditions falls within the predetermined threshold 512. The predetermined threshold may represent an acceptable level of deviation between the second set of firing conditions and the first set of firing conditions that allows for the munition 70 to reach the target area. In the absence of the processed signal, where the comparison of the second launch parameter set to the initial launch parameter set falls outside of a predetermined threshold 514, the controller 120 of the electronic device 110 associated with the munition 70 may disarm the munition 518. The disarming of the munition 518 may be associated with an in-flight disarm feature. In the presence of the processed signal, the controller 120 of the electronic device 110 associated with the munition 70 may be configured to deploy at least one wing and/or at least one fin of the munition as previously described herein. The method 500 of confirming the intended firing status of the munition may occur, from the launch of the munition to the generation of the processed signal, or alternatively the disarming of the munition, within two (2) seconds of launch. In optional embodiments, the time to confirm the intended firing status of the munition may be set by a user or administrator 104.

Continuing with the operation 230, the munition 90 may proceed along the flight path 99 (guided or not) in the direction of the one or more targetable assets 92, eventually terminating in an impact on the one or more targetable assets 92 in the mission environment 90. At impact, the warhead 84 within the munition 70 may be detonated by the fuze, wherein the fuze is any one of a time-based fuze, a proximity-based fuze, an impact-based fuze, a distance-measuring fuze, or an electronic-time fuze. Continuing with the operation 232 of disabling the flight path 99, the one or more electronic devices 110 may remotely terminate the flight path 99 of the munition 70 where any one of the following conditions are met or triggered: the munition 70 is disabled by a user-initiated event, either by remotely terminating the motor of the munition 70 or remotely altering the flight path 99 by and through the guidance system 87 of the munition 70; the one or more targetable assets 92 are identified within, or become located in proximity to, the one or more non-targetable assets 94 during the flight path 99 of the munition 70; or at least one of the two or more fins, such as the first fins 80 and/or the second fins 82, or at least one of the two or more wings 86, and combinations thereof, are detached from the munition frame 71 or are otherwise damaged or rendered unworkable.

To facilitate the understanding of the embodiments described herein, a number of terms have been defined above. The terms defined herein have meanings as commonly understood by a person of ordinary skill in the areas relevant to the present invention. The terminology herein is used to describe specific embodiments of the invention, but their usage does not delimit the invention, except as set forth in the claims.

The term "user" as used herein unless otherwise stated may refer to an operator, such as a soldier or other individual operating in the mission environment 90, an autonomous system, or any other person or entity as may be, e.g., associated with the electronic device 110, the at least one mobile munition assembly 10, the system 100, the network 102, and/or the administrator 104.

The term "mobile," as used in connection with the at least one mobile munition assembly 10, should be interpreted to mean portable, movable, mobile, haulable, transportable, or wieldy, such that a human-user (e.g., solider or other individual operating in the mission environment 90) may manageably lift, carry, and/or transport the at least one mobile munition assembly 10 in the mission environment 90.

The term "processor" as used herein may refer to at least general-purpose or specific-purpose processing devices, such as a central processing unit, and/or logic as may be understood by one of skill in the art, including but not limited to a microprocessor, a microcontroller, a state machine, and the like. The processor can also be implemented as a combination of computing devices, e.g., a combination of a digital signal processor (DSP) and a microprocessor, a plurality of microprocessors, one or more microprocessors in conjunction with a DSP core, or any other such configuration.

The terms "connected," "attached," "mounted," "fixed," "supported," "engaged," and the like, or any variation thereof, when referring to any mechanical, structural, physical, or tangible construction or configuration, should be interpreted to mean any manner of joining two objects including, but not limited to, the use of any fasteners such as screws, nuts and bolts, bolts, pin and clevis, and the like allowing for a stationary, translatable, or pivotable relationship; being integrally formed as a single part together; any mechanical fit such as a friction fit, interference fit, slidable fit, rotatable fit, pivotable fit, and the like; any combination thereof; and the like.

It is understood that various operations, steps, or algorithms, including the method 200, as described in connection with the system 100, including (without limitation) the one or more electronic devices 110 (including those of the one or more electronic devices 110 associated with the at least one mobile munition assembly 10), the administrator 104, or alternative devices or computer structures or hierarchies, can be embodied directly in hardware, in a computer program product such as a software module executed by the processor 13 or any process related to, or embodied by, the foregoing. The computer program product can reside in the storage 18, which may include RAM memory, flash memory, ROM memory, EPROM memory, EEPROM memory, registers, hard disk, a removable disk, or any other form of computer-readable medium known in the art.

Terms such as "a," "an," and "the" are not intended to refer to only a singular entity, but rather include the general class of which a specific example may be used for illustration.

The phrases "in one embodiment," "in optional embodiment(s)," and "in an exemplary embodiment," or variations thereof, as used herein does not necessarily refer to the same embodiment, although it may.

As used herein, the phrases "one or more," "at least one," "at least one of," and "one or more of," or variations thereof, when used with a list of items, means that different combinations of one or more of the items may be used and only one of each item in the list may be needed. For example, "one or more of" item A, item B, and item C may include, for example, without limitation, item A or item A and item B. This example also may include item A, item B, and item C, or item B and item C.

Conditional language used herein, such as, among others, "can," "might," "may," "e.g.," and the like, unless specifically stated otherwise, or otherwise understood within the context as used, is generally intended to convey that certain embodiments include, while other embodiments do not include, certain features, elements, and/or states. The conditional language is not generally intended to imply that features, elements and/or states are in any way required for one or more embodiments or that one or more embodiments necessarily include logic for deciding, with or without author input or prompting, whether these features, elements and/or states are included or are to be performed in any particular embodiment. Thus, such conditional language is not generally intended to imply that features, elements, and/or states are in any way required for one or more embodiments, whether these features, elements, and/or states are included or are to be performed in any particular embodiment.

The previous detailed description has been provided for the purposes of illustration and description. Thus, although there have been described particular embodiments of a new and useful invention, it is not intended that such references be construed as limitations upon the scope of this disclosure except as set forth in the following claims. Thus, it is seen that the apparatus of the present disclosure readily achieves the ends and advantages mentioned as well as those inherent therein. While certain preferred embodiments of the disclosure have been illustrated and described for present purposes, numerous changes in the arrangement and construction of parts and steps may be made by those skilled in the art, which changes are encompassed within the scope and spirit of the present disclosure as defined by the appended claims.

I claim:

1. A method of executing a mission in a mission environment for at least one mobile munition assembly, each of the at least one mobile munition assembly comprising a container and at least one launcher, wherein each of the at least one launcher is configured to receive a munition, the method comprising:

deploying the at least one mobile munition assembly on a launch terrain surface in the mission environment, wherein the at least one launcher of the at least one mobile munition assembly is oriented generally orthogonal to the launch terrain surface;

acquiring an image of a target area located within the mission environment;

forming a secure network comprising a plurality of electronic devices, wherein a first electronic device of the plurality of electronic devices is associated with the at least one mobile munition assembly positioned at a current location within the mission environment;

providing a first set of firing conditions to the munition, the first set of firing conditions corresponding at least to the target area;

receiving, at a second electronic device of the plurality of electronic devices and via the secure network, signals representative of an orientation of the at least one launcher indicating that the at least one launcher of the at least one mobile munition assembly is oriented generally orthogonal to the launch terrain surface;

providing authorization to the first electronic device of the at least one mobile munition assembly for firing based at least on an airspace collision avoidance status dynamically determinable over a maximum future time of launch consideration ($t_{max}$) and on the signals representative of the orientation of the at least one launcher;

based on the provided authorization, vertically firing the munition, in a launch configuration, from the at least one launcher to a height according to the first set of firing conditions; and at the fired munition:

measuring a second set of firing conditions;

confirming an intended firing status of the munition by comparing the second set of firing conditions to the provided first set of firing conditions;

when the fired munition reaches the height vertically, transitioning the fired munition from the launch configuration to a flight configuration by deploying at least one deployable wing and at least one deployable fin; and guiding the munition, in the flight configuration, to the target area.

2. The method of claim 1, wherein providing authorization to the first electronic device of the at least one mobile munition assembly for firing further comprises:

receiving signals representative of a class of the munition and a class of an aircraft;

receiving signals representative of situational awareness (SA) of the at least one mobile munition assembly and situational awareness (SA) of the aircraft;

determining future position areas of the munition based at least on the signals representative of the class of the munition and on the signals representative of the situational awareness (SA) of the at least one mobile munition assembly; and determining future position areas of the aircraft based at least on the signals representative of the class of the aircraft and on the signals representative of the situational awareness (SA) of the aircraft.

3. The method of claim 2, wherein:

receiving the signals representative of the class of the munition further comprises receiving a maximum launch impulse per mass (ΔV) and a maximum targetable range of the munition; and determining the future position areas of the munition further comprises:

determining future position areas based on at least one potential malfunction status of the munition;

determining future position areas based on a maximum flight path of the munition; and superimposing the future position areas based on the at least one potential malfunction status and the future position areas based on the maximum flight path of the munition.

4. The method of claim 2, wherein:

receiving the signals representative of the class of the aircraft further comprises receiving a maximum velocity of the aircraft;

receiving the signals representative of the situational awareness (SA) of the aircraft further comprises receiving signals representative of a time when the signals representative of the situational awareness (SA) of the aircraft were reported and signals representative of a last reported velocity ($V_{last}$); and determining the future position areas of the aircraft is based further on at least one of the maximum velocity of the aircraft, the time when the signals representative of the situational awareness (SA) of the aircraft were reported, and the last reported velocity ($V_{last}$).

5. The method of claim 1, further comprising:

receiving, at the at least one mobile munition assembly, a signal representative of a user command; and wherein providing authorization to the first electronic device of the at least one mobile munition assembly for firing is based further on the signal representative of the user command.

6. The method of claim 5, wherein:

the signal representative of the user command comprises signals representative of a class or of a situational awareness (SA) of at least one of the at least one mobile munition assembly or an aircraft.

7. The method of claim 1, wherein confirming the intended firing status of the munition further comprises:

generating a processed signal based on at least the compared first and second sets of firing conditions; and disarming the munition in the absence of the processed signal.

8. The method of claim 7, wherein:

the second set of firing conditions comprises at least one of heat, shock, light, static electricity, spin, acceleration, air pressure, or time elapsed since the firing.

9. The method of claim 1, further comprising:

capturing, at the fired munition, at least one image of the target area;

wherein providing the first set of firing conditions to the munition further comprises providing the acquired image of the target area; and wherein guiding the munition to the target area further comprises comparing the at least one captured image of the target area to the acquired image of the target area.

10. The method of claim 1, further comprising:

capturing, at the fired munition, two or more successive images of the target area; and wherein guiding the munition to the target area further comprises comparing a later of the successive images to an earlier of the successive images.

* * * * *